US008178273B2

(12) United States Patent
Inoue et al.

(10) Patent No.: US 8,178,273 B2
(45) Date of Patent: May 15, 2012

(54) CARRIER AND MANUFACTURING METHOD THEREOF, DEVELOPER, PROCESS CARTRIDGE, IMAGE FORMING APPARATUS, AND IMAGE FORMING METHOD

(75) Inventors: Ryota Inoue, Mishima (JP); Chiaki Tanaka, Izunokuni (JP); Shinichi Kuramoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1057 days.

(21) Appl. No.: 11/853,520

(22) Filed: Sep. 11, 2007

(65) Prior Publication Data

US 2008/0063972 A1 Mar. 13, 2008

(30) Foreign Application Priority Data

Sep. 12, 2006 (JP) ..... 2006-247288
Sep. 14, 2006 (JP) ..... 2006-249175

(51) Int. Cl.
*G03G 9/113* (2006.01)

(52) U.S. Cl. ..... 430/137.13; 430/111.35

(58) Field of Classification Search ..... 430/137.13, 430/111.35
See application file for complete search history.

(56) References Cited

U.S. PATENT DOCUMENTS

| | | | | |
|---|---|---|---|---|
| 5,514,512 | A | 5/1996 | Cunningham et al. | |
| 5,858,596 | A * | 1/1999 | Tajima et al. | 430/108.2 |
| 6,348,533 | B1 * | 2/2002 | Kishimoto et al. | 524/398 |
| 7,629,104 | B2 * | 12/2009 | Tanaka et al. | 430/137.13 |
| 2007/0031750 | A1 | 2/2007 | Tanaka et al. | |
| 2007/0059628 | A1 | 3/2007 | Tanaka et al. | |
| 2007/0202427 | A1 | 8/2007 | Tanaka | |

FOREIGN PATENT DOCUMENTS

| | | |
|---|---|---|
| JP | 55-127569 | 10/1980 |
| JP | 55-157751 | 12/1980 |
| JP | 56-140358 | 11/1981 |
| JP | 57-96355 | 6/1982 |
| JP | 57-96356 | 6/1982 |
| JP | 58-207054 | 12/1983 |
| JP | 61-110161 | 5/1986 |
| JP | 62-273576 | 11/1987 |
| JP | 9-269614 | 10/1997 |
| JP | 9-319161 | 12/1997 |
| JP | 10-186731 | 7/1998 |
| JP | 11-344840 | 12/1999 |
| JP | 2002-14493 | 1/2002 |
| JP | 3286849 | 3/2002 |
| JP | 2004-833 | 1/2004 |
| JP | 2005-292175 | * 10/2005 |
| JP | 2006-91372 | 4/2006 |
| JP | 2006-106208 | 4/2006 |

OTHER PUBLICATIONS

Japanese Patent Office machine-assisted translation of JP 2006-106208 (pub. Apr. 2006).*
Japanese Patent Office machine-assisted translation of JP 2005-292175 (pub. Oct. 2005).*
Office Action issued Sep. 21, 2010 in JP Application No. 2006-249175.
U.S. Appl. No. 11/944,552, filed Nov. 23, 2007, Inoue, et al.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

To provide (1) a method for manufacturing a carrier, including: dissolving a coating material composed of a plurality of types of materials in a fluid containing at least one of a supercritical fluid and a subcritical fluid; and lowering the solubility of the solution by controlling at least one of pressure and temperature to form a coating layer on a core surface, or (2) a method for manufacturing a carrier, including: dispersing or dissolving a coating material in a fluid containing at least one of a supercritical fluid and a subcritical fluid; and lowering solubility of the solution by controlling at least one of pressure and temperature to form a coating layer on a core surface, wherein the coating material contains at least a silicone resin, and the silicone resin has a weight-average molecular weight (Mw) of 800 to 5,000.

9 Claims, 6 Drawing Sheets

CARRIER AND MANUFACTURING METHOD THEREOF, DEVELOPER, PROCESS CARTRIDGE, IMAGE FORMING APPARATUS, AND IMAGE FORMING METHOD

BACKGROUND OF THE INVENTION

1. Field of the Invention

The present invention relates to a carrier that is used for latent electrostatic image development and is suitable for electrophotography, electrostatic recording, electrostatic printing and the like and a manufacturing method thereof, a developer using the carrier; and a process cartridge, image forming apparatus and image forming method using the developer.

2. Description of the Related Art

A dry development system used for electrophotography makes toner that has caused friction with a charging member electrostatically adhere to a latent electrostatic image to form a visible image. Such dry development systems include a one-component development system using toner as the main component and a two-component development system using glass beads, magnetic carriers, or carriers prepared by coating the surfaces of such materials with resin or the like, in combination with toner.

In a developer used in such a two-component development system, minute toner particles are held on relatively large core surfaces by an electric force produced by friction therebetween. When this developer is made close to a latent electrostatic image, owing to an electric field formed by the latent electrostatic image, the toner overcomes the binding force with the core, and transferred on the latent electrostatic image to develop this image. Then, the developer is repeatedly used while being replenished with the toner consumed by development. Therefore, during use over an extended period of time, the core must always frictionally charge the toner with a desired polarity and to a sufficient amount of charge. However, due to inter-particle collision, mechanical stirring of particles within a development device, or heat generation caused by these phenomena, a phenomenon called "spent toner" occurs where the toner is fusion-bonded to the core surface, and thereby charging characteristics of the core deteriorates with operating time. As a result, since background smearing of an image and toner scattering occur, it becomes necessary to replace the entire developer.

For preventing such a spent phenomenon, many proposals have been made for extending the lifespan of carriers by coating the core surface with a resin having a low surface energy, for example, a fluorine resin, a silicone resin, or the like. The proposed carriers include, for example, a carrier coated with a room-temperature curable silicone resin and a positive charge nitrogen resin (see Japanese Patent Application Laid-Open (JP-A) No. 55-127569), a carrier coated with a coating material containing at least one type of modified silicone resin (see JP-A No. 55-157751), a carrier having a coating layer containing a room-temperature curable silicone resin and a styrene-acryl resin (see JP-A No. 56-140358), a carrier for which the surface of a core particle is coated with two or more layers of silicone resin, with no adhesion provided between the adjacent layers (see JP-A No. 57-96355), a carrier for which a multilayered silicone resin is applied to the surface of a core particle (see JP-A No. 57-96356), a carrier whose surface is coated with a silicone resin containing silicon carbide (see JP-A No. 58-207054), a positively charged carrier coated with a material having a critical surface tension of 20 dyn/cm or less (see JP-A No. 61-110161), and a developer composed of carriers coated with a coating material containing fluorinated alkyl acrylate and a toner containing a chromium-containing azo dye (see JP-A No. 62-273576).

Recently, there has been a trend to reduce the particle diameter of toner for realizing a high image quality, and as a result, toner spent to the carrier easily occurs. In addition, by a conventional spray coating, it is difficult to uniformly moisten the carrier surface with a coating material, and therefore, it is difficult to manufacture a carrier having adhesion between the coating film and core and a uniform film thickness and film quality. Furthermore, in the case of a full-color toner, since a low-softening-point resin is used in order to obtain a sufficient color tone, in comparison with that of a black toner, the spent amount to the carrier is large, the amount of toner charge is lowered, and toner scattering and background smears occur. Thus, a full-color electrophotographic system has a problem that the image density of, in particular, a highlight is easily changed and a high image quality cannot be maintained when the amount of toner charge is lowered.

For improved carrier durability, it has also been proposed to provide a coating layer of resin matrix composed of low surface energy substance, in which fine particles and conductivity-imparting material are dispersed, to thereby control spent resistance, film strength, and electrical characteristics (see JP-A Nos. 09-319161, 09-269614, and 10-186731). However, in these proposals, since a dispersion prepared by adding fine particles to an organic solvent is applied by high-temperature spray coating, there is a problem that it is difficult to unify the amount of charge due to aggregation of the fine particles.

Conventional spray coating techniques also suffer from operational problems, such as regulation of volatile organic compounds (VOC) resulting from an organic solvent used for formation of a coating layer on the core surface, generation of liquid waste, and requirement of energy for drying.

In order to overcome these problems, for example, as manufacturing methods for carrier that involve an organic solvent-free dry powder process, manufacturing methods that involve use of a supercritical fluid have been proposed (see U.S. Pat. No. 5,514,512). However, this proposal discloses application of a coating resin, which has been polymerized in a supercritical fluid, by melting it in a heated state, and the resin material is an acrylic resin; thus the aforementioned toner spent problem has not yet been solved.

In addition, for improved carrier durability, as a carrier which is stable without deterioration in charging characteristics even when the carrier coating layer has worn down during continuous use, a carrier with a layered structure where silane coupling agents in the coating layer have a concentration gradient has been proposed (see Japanese Patent (JP-B) No. 3286849). However, since it is necessary to dissolve silane coupling agents having different concentrations in organic solvents and to subsequently apply the resultant solutions by spray coating sequentially, there is a problem that interfaces easily occur in the coated layers, the degree of film scraping increases, and it is difficult to control the layered structure.

Furthermore, in the manufacturing method for carrier using a supercritical fluid (see JP-A No. 2006-106208), a silicone resin is used for the coating material; however, its solubility to the supercritical fluid is insufficient, and a carrier is manufactured through a process in which a plasticized and microdispersed silicone resin is sprayed simultaneously with core for coating of the core surface. For this reason, it results in non-uniform coating thickness and unevenness in the coating layer, and therefore, it results in failure to obtain a coating thickness sufficient to ensure carrier durability.

Furthermore, in the fields of electrical appliances, automobile bodies, ship hulls, buildings, and the like, as a coat manufacturing method for forming a film without using an organic solvent for a base material having a complicated shape and a base material having a narrow gap and without applying a heating treatment, a method for applying a silicone resin or the like to a base material such as a stainless steel plate and an aluminum plate by making the base material contact with the silicone resin or the like in the presence of a supercritical fluid within a container and then reducing the pressure of the container has been proposed (see JP-A No. 2004-833).

However, it is considerably difficult to conceive application of techniques of such different fields to manufacturing of a carrier coating layer, and even if this could be conceived, the solubility of the silicone resin to the supercritical fluid is low, the resultant film has a small thickness, and thus carrier durability is not satisfactory even when the film is used for a carrier coating layer.

As described above, a carrier that has a coating layer on the core surface, is high in adhesion between the core and coating layer, and has a coating layer with a uniform thickness has not yet been provided, and furthermore, from the perspective of global environmental loads and resource savings as well, conventional carrier manufacturing methods and carriers still have many problems that require solutions under the present circumstances.

BRIEF SUMMARY OF THE INVENTION

It is a first object of the present invention to provide: a carrier manufacturing method capable of obtaining coated carrier particles having a coating layer with a structure having a moderate concentration gradient without an interface in the coating layer, and thus capable of manufacturing a stable carrier that is high in durability, can form an image that is free from toner scattering and background smears and high in density, and never causes deterioration in charging characteristics even when the carrier coating layer wears down during continuous use; a carrier manufactured by using the carrier manufacturing method; a developer capable of forming an image free from toner scattering and background smears and high in image density using the carrier; and a process cartridge, an image forming apparatus, and an image forming method using the developer.

It is a second object of the present invention to provide a method for manufacturing a carrier that has a coating film on the core surface, is high in adhesion between the core and coating layer, and has a coating layer with a uniform thickness, a carrier manufactured by using the carrier manufacturing method, a developer capable of forming an image free from toner scattering and background smears and high in image density using the carrier, and an image forming method, a process cartridge, and an image forming apparatus using the developer.

Means for solving the problems are as follows:

<1> A method for manufacturing a carrier including: dissolving a coating material composed of a plurality of types of materials in a fluid containing at least one of a supercritical fluid and a subcritical fluid to prepare a solution; and lowering the solubility of the solution by controlling at least one of pressure and temperature to form a coating layer on a core surface.

<2> The method according to <1>, wherein the coating material is applied on the core surface under coexistence of the coating material composed of a plurality of types of materials.

<3> The method according to any one of <1> to <2>, wherein one of the supercritical fluid and subcritical fluid is carbon dioxide.

<4> The method according to any one of <1> to <3>, wherein the coating material is composed of three to five types of materials.

<5> The method according to any one of <1> to <4>, wherein the coating material is composed of five types of materials.

<6> The method according to any one of <1> to <5>, wherein the coating material is composed of materials that differ in solubility in the supercritical fluid and subcritical fluid.

<7> The method according to any one of <1> to <6>, wherein the coating material is composed of materials that differ in the number of functional groups from each other.

<8> The method according to any one of <1> to <7>, wherein the coating material contains as a main skeleton a silicone resin represented by the following structural formula (i):

Structural Formula (i)

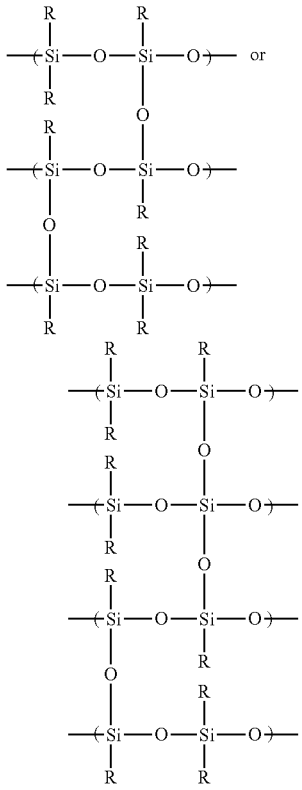

where R represents a hydrogen atom, hydroxyl group, alkoxy group, alkyl group, aryl group, or amino group.

<9> The method according to any one of <1> to <8>, wherein the coating material contains an amino-modified silicone resin as a main skeleton.

<10> The method according to <9>, wherein the coating material is composed of resins that differ in the amino modification ratio from each other.

<11> The method for manufacturing a carrier according to any one of <8> to <10>, wherein the silicone resin has a weight-average molecular weight (Mw) of 500 to 100,000.

<12> A carrier manufactured by the carrier manufacturing method according to any one of <1> to <11>.

<13> A developer including the carrier according to <12> and a toner.

<14> A process cartridge including: a latent electrostatic image bearing member; and a developing unit configured to develop a latent electrostatic image by use of the developer according to <13> to form a visible image.

<15> An image forming apparatus including: a latent electrostatic image bearing member; a latent electrostatic image forming unit configured to form a latent electrostatic image on the latent electrostatic image bearing member; a developing unit configured to develop the latent electrostatic image by use of the developer according to <13> to form a visible image; a transferring unit configured to transfer the visible image onto a recording medium; and a fixing unit configured to fix a transfer image transferred onto the recording medium.

<16> An image forming method including: forming a latent electrostatic image on a latent electrostatic image bearing member; developing the latent electrostatic image by use of the developer according to <13> to form a visible image; transferring the visible image onto a recording medium; and fixing a transfer image transferred onto the recording medium.

<17> A method for manufacturing a carrier including: dissolving or dispersing a coating material in a fluid containing at least one of a supercritical fluid and a subcritical fluid to prepare a solution; and lowering the solubility of the solution by controlling at least one of pressure and temperature to form a coating layer on a core surface, wherein the coating material contains at least a silicone resin, and the silicone resin has a weight-average molecular weight (Mw) of 800 to 5,000.

<18> The method according to <17>, wherein at least one of the supercritical fluid and subcritical fluid is carbon dioxide.

<19> The method according to any one of <17> to <18>, wherein the silicone resin is a methyl silicone resin.

<20> The method according to any one of <17> to <19>, wherein a ratio (Mw/Mn) between a weight-average molecular weight (Mw) and a number-average molecular weight (Mn) of the silicone resin is 1.40 to 2.10.

<21> The method according to claim 12, wherein a ratio (R/S) between a weight R(g) of the silicone resin and a surface area S($m^2$) of the core is 0.1 to 3.5.

<22> A carrier manufactured by the manufacturing method according to any one of <17> to <21>.

<23> A developer including the carrier according to <22> and a toner.

<24> An image forming method including: forming a latent electrostatic image on a latent electrostatic image bearing member; developing the latent electrostatic image by use of a developer to form a visible image; transferring the visible image onto a recording medium; and fixing a transfer image transferred onto the recording medium, wherein the developer corresponds to the developer according to <23>.

<25> A process cartridge including: a latent electrostatic image bearing member that bears thereon a latent electrostatic image; and a developing unit configured to develop the latent electrostatic image on the latent electrostatic image bearing member by use of a developer to form a visible image, wherein the developer is the developer according to <23>.

<26> An image forming apparatus including: a latent electrostatic image bearing member; a latent electrostatic image forming unit configured to form a latent electrostatic image on the latent electrostatic image bearing member; a developing unit configured to develop the latent electrostatic image formed on the latent electrostatic image bearing member by use of a developer to form a visible image; a transferring unit configured to transfer the visible image formed on the latent electrostatic image bearing member onto a recording medium; and a fixing unit configured to fix a transfer image transferred onto the recording medium, wherein the developer is the developer according to <23>.

A method for manufacturing a carrier of the present invention is, according to a first embodiment, directed to lowering the solubility of a solution, prepared by dissolving a coating material composed of a plurality of types of materials in a fluid containing at least one of a supercritical fluid and a subcritical fluid, by controlling at least one of pressure and temperature to form a coating layer on a core surface.

According to the method for manufacturing a carrier of the first embodiment of the present invention, the solubility of a solution, prepared by dissolving a coating material composed of a plurality of types of materials in a fluid containing at least one of a supercritical fluid and a subcritical fluid, is lowered by controlling at least one of pressure and temperature to form a coating layer on a core surface. Therefore, the coating material composed of a plurality of types of materials under coexistence can be coated on the core surface selectively and sequentially, coated carrier particles having a coating layer with a structure having a moderate concentration gradient without an interface in the coating layer can be obtained, and thus a stable carrier that is high in durability, can form an image that is free from toner scattering and background smears and high in density, and never causes deterioration in charging characteristics even when the carrier coating layer has worn down during continuous use can be efficiently manufactured while meeting the volatile organic compound (VOC) regulations, producing no liquid waste, and requiring little drying energy.

A method for manufacturing a carrier of the present invention is, according to a second embodiment, directed to lowering the solubility of a solution, prepared by dissolving or dispersing a coating material in a fluid containing at least one of a supercritical fluid and a subcritical fluid, by controlling at least one of pressure and temperature to form a coating layer on a core surface, wherein the coating material contains at least a silicone resin, and the silicone resin has a weight-average molecular weight (Mw) of 800 to 5,000.

According to the method for manufacturing a carrier of the second embodiment of the present invention, in a fluid containing at least one of a supercritical fluid and a subcritical fluid, a coating layer is formed on a core surface, wherein the coating material contains a weight-average molecular weight (Mw) of 800 to 5,000. Therefore, a carrier that is high in adhesion between the core and coating layer, has a coating layer with a uniform thickness, is high in mechanical strength, and is excellent in toner charging ability and temporal stability can be manufactured. Furthermore, according to this manufacturing method, a carrier with a coating layer can be efficiently manufactured while meeting the volatile organic compound (VOC) regulations, producing no liquid waste, and requiring little drying energy.

A developer used in the present invention contains the carrier of any one of the first embodiment and second embodiment and a toner. Formation of an image that is free from toner scattering and background smears, and is high in image density can be carried out by use of the developer.

A process cartridge used in the present invention includes at least: a latent electrostatic image bearing member; and a developing unit configured to develop a latent electrostatic image by use of the developer to form a visible image. As a result, since the process cartridge is attachable to and detachable from an image forming apparatus, is excellent in convenience, and uses the developer of the present invention, a high-quality image can be obtained that is high in mechanical strength, is free from toner scattering and background smears, and is high in image density and sharpness.

An image forming apparatus used in the present invention includes at least: a latent electrostatic image bearing member; a latent electrostatic image forming unit; a developing unit; a transferring unit; and a fixing unit. In the image forming apparatus of the present invention, the latent electrostatic image forming unit forms a latent electrostatic image on the latent electrostatic image bearing member. The developing unit develops the latent electrostatic image by use of the developer to form a visible image. The transferring unit transfers the visible image onto a recording medium. The fixing unit fixes a transfer image transferred onto the recording medium. As a result, a high-quality image that is high in mechanical strength, is free from toner scattering and background smears, and is high in image density and sharpness can be obtained.

An image forming method used in the present invention includes at least: a latent electrostatic image forming step; a developing step; a transferring step; and a fixing step. In the image forming method of the present invention, a latent electrostatic image is formed on a latent electrostatic image bearing member in the latent electrostatic image forming step. In the developing step, the latent electrostatic image is developed by use of the developer to form a visible image. In the transferring step, the visible image is transferred onto a recording medium. In the fixing step, a transfer image transferred onto the recording medium is fixed. As a result, a high-quality image that is high in mechanical strength, is free from toner scattering and background smears, and is high in image density and sharpness can be obtained.

Figure 1:
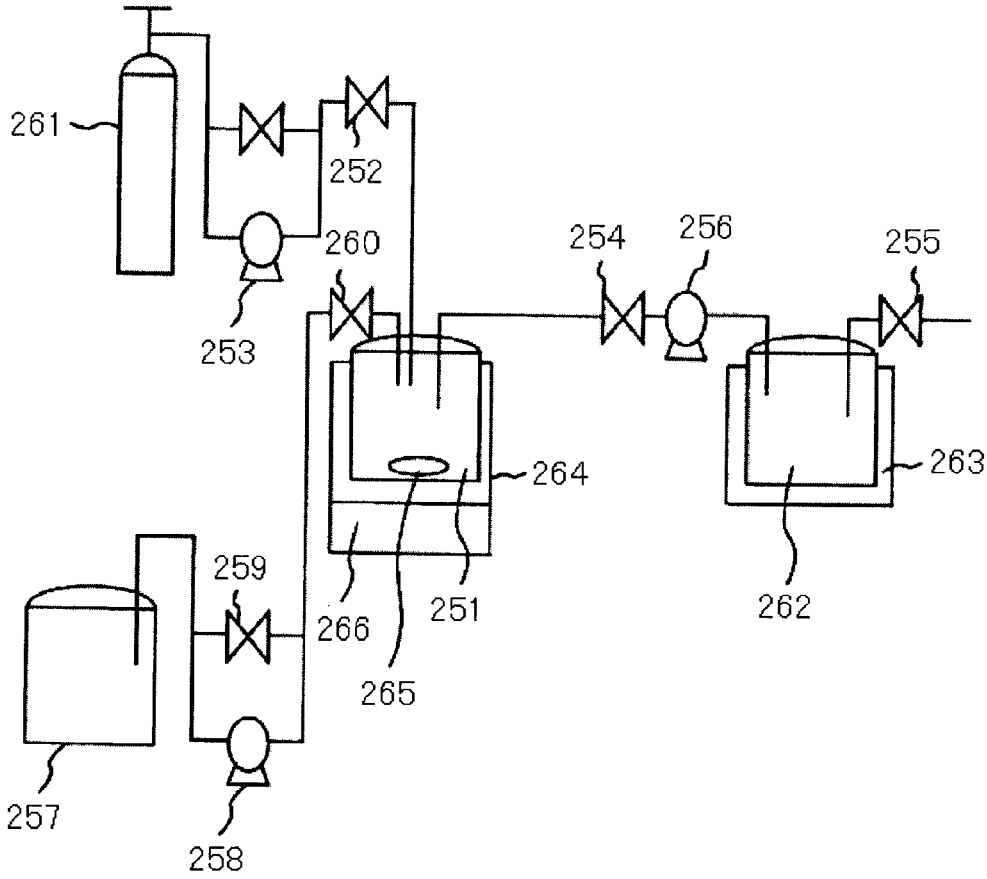
FIG. 1 is a schematic view showing an example of a device used for a carrier manufacturing method of the present invention.

DETAILED DESCRIPTION OF THE INVENTION (Carrier Manufacturing Method and Carrier)

A carrier manufacturing method of the present invention is, according to a first embodiment, directed to lowering the solubility of a solution, prepared by dissolving a coating material composed of a plurality of types materials in a fluid containing one of a supercritical fluid and a subcritical fluid, by controlling at least one of pressure and temperature to form a coating layer on the core surface.

A carrier manufacturing method of the present invention is, according to a second embodiment, directed to lowering the solubility of a solution, prepared by dissolving or dispersing a coating material in a fluid containing one of a supercritical fluid and a subcritical fluid, by controlling at least one of the pressure and temperature to form a coating layer on the core surface, wherein the coating material contains at least a silicone resin, and the weight-average molecular weight (Mw) of the silicone resin is in a range of 800 to 5,000.

A carrier of the present invention is manufactured by the carrier manufacturing method according to one of the first embodiment and the second embodiment of the present invention.

Hereinafter, details of the carrier of the present invention will be made apparent through a description of the carrier manufacturing method of the present invention.

The method for lowering the solubility of a solution, in which a coating material is dissolved or dispersed, by controlling one of the pressure or temperature is not particularly limited, such methods include, for example, as will also be described later, a method for restoring the pressure of the solution to a normal pressure.

—Supercritical Fluid and Subcritical Fluid—

The supercritical fluid means a fluid that has intermediate properties between a gas and a liquid, has properties such as being fast in mass transfer and heat transfer (as a liquid) and being low in viscosity (as a gas), and can continuously greatly change the density, dielectric constant, solubility parameter, free volume, and the like by changing the temperature and pressure. Furthermore, the supercritical fluid can even follow a minute undulation (surface) to wet the surface with the supercritical fluid (contact with the supercritical fluid) since it has an extremely small surface tension compared with those of organic solvents.

As the supercritical fluid, any supercritical fluid can be used without particular limitation as long as it is a fluid that exists as a noncondensable high-density fluid in a temperature and pressure region exceeding a limit (critical point) where a gas and a liquid can coexist, does not condensate when being compressed, and is in a state of a critical temperature or more and a critical pressure or more, and can be appropriately selected in the present invention according to the purpose; however, one that is low in critical temperature and critical pressure is preferable. In addition, as the subcritical fluid, any subcritical fluid can be used without particular limitation as long as it exists as a high-pressure liquid in a temperature and pressure region in the vicinity of the critical point, and can be appropriately selected in the present invention according to the purpose.

Examples of the supercritical fluid or subcritical fluid include carbon monoxide, carbon dioxide, ammonia, nitrogen, water, methanol, ethanol, ethane, propane, 2,3-dimethylbutane, benzene, chlorotrifluoromethane, and dimethyl ether. Among these, carbon dioxide is particularly preferable since this can easily reach a supercritical state at a critical pressure of 7.3 MPa and a critical temperature of 31° C., is nonflammable and highly safe, allows obtaining a carrier with a hydrophobic surface as this is a nonaqueous solvent, and is globally environmentally friendly from the point that it is easy to recover and recycle as this is gasified by only restoring the pressure to a normal pressure (releasing pressure), no drying is required for a carrier obtained, and no liquid waste is produced.

For the supercritical fluid or the subcritical fluid, one of these may be used alone or two or more may be used in combination as a mixture. When used in combination, it is natural to include a supercritical fluid or a subcritical fluid.

The critical temperature and critical pressure of the supercritical fluid are not particularly limited and any critical temperature and critical pressure of the supercritical fluid can be appropriately selected according to the purpose, the critical temperature is preferably −273° C. to 300° C., and more preferably, 0° C. to 200° C. In addition, the lower the critical pressure is, the more advantageous it is in terms of an apparatus load, facility cost, kinetic energy, and the like; however, in practice, the critical pressure is preferably 1 MPa to 100 Mpa, and more preferably, 1 MPa to 50 MPa.

In the present invention, by actively using the properties of the supercritical fluid or the subcritical fluid, a coating layer can be formed on the core surface.

Furthermore, fine particles of an inorganic substance can be made to uniformly exist in the coating layer.

Furthermore, since a supercritical fluid is also easily separated from an objective product and can be recovered and recycled, an innovative carrier manufacturing method with a low environmental load not using water or an organic solvent as conventionally used can be realized.

Besides the supercritical fluid or subcritical fluid, another fluid can be used in combination. As such another fluid, one that can easily control solubility of the coating resin is preferable. Specifically, methane, ethane, propane, ethylene, and the like are suitable.

Furthermore, besides the supercritical fluid or subcritical fluid, an entrainer (azeotropic agent) can also be added. This addition of an entrainer enhances the solubility of a coating resin. Although the entrainer is not particularly limited and can be appropriately selected according to the purpose, a polar organic solvent is preferable. Examples of the polar organic solvent include methanol, ethanol, propanol, butanol, hexane, toluene, ethyl acetate, chloroform, dichloromethane, ammonia, melamine, urea, and thioethyleneglycol. Among these, lower alcohol solvents of 4 to 6 carbon atoms (preferably 1 to 4 carbon atoms) that exhibit a poor solvency under normal temperature and normal pressure are suitable.

<Coating Layer>

The coating layer, according to the first embodiment, contains at least a coating material, and further contains other components according to necessity. In addition, the coating layer is formed with a coating material composed of a plurality of types materials, for which used are materials with different solubilities into the supercritical fluid and subcritical fluid.

The coating material preferably is composed of three to five types of materials, from the point of allowing to obtain a higher density and sharper image and more effectively preventing toner scattering and background smears, and more preferably composed of five materials from the point of allowing to obtain a still sharper image.

—Coating Material—

The coating material (hereinafter, sometimes referred to as "coating resin") is not particularly limited and can be appropriately selected according to the purpose among known resins. Examples thereof include amino resins, polyvinyl resins, polystyrene resins, halogenated olefin resins, polyester resins, polycarbonate resins, polyethylene resins, polyvinyl fluoride resins, polyvinylidene-fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as a terpolymer of tetrafluoroethylene, vinylidene fluoride, a non-fluorinated monomer, and silicone resins. These may be used alone or in combination of two or more. Among these, silicone resins are particularly preferable in consideration of their high effectiveness. In addition, these coating resins are preferable since they can change their solubility to a supercritical fluid and subcritical fluid by changing the number of functional groups according to necessity. The number of functional groups is not particularly limited and any number can be appropriately changed according to the purpose.

Although the silicone resin is not particularly limited and can be appropriately selected from generally known silicone resins according to the purpose, for example, a straight silicone resin expressed by the following structural formula (i) is suitable.

Structural Formula (i)

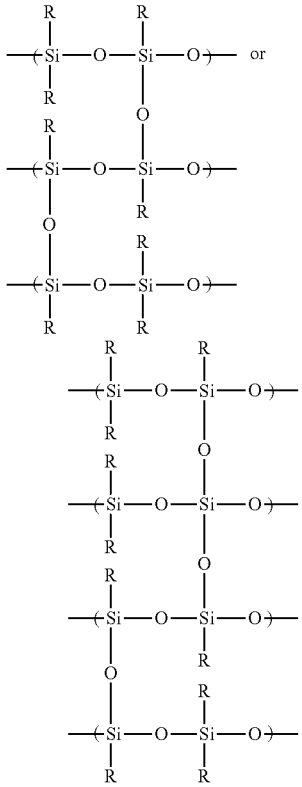

In the structural formula (i), R represents a hydrogen atom, hydroxyl group, alkoxy group, alkyl group, aryl group, or amino group.

Examples of the alkoxy group include a methoxy group and ethoxy group. Examples of the alkyl group include a methyl group, ethyl group and propyl group. Examples of the aryl group include phenyl group, tolyl group, and xylyl group.

Examples of the amino group include an aminopropyl group, iminopropyl group and aminophenoxymethyl group.

Although the weight-average molecular weight (Mw) of a silicone resin of the first embodiment is not particularly limited and can be appropriately selected according to the purpose, this is preferably 500 to 100,000, and more preferably, 1,000 to 10,000.

Here, the weight-average molecular weight of the silicone resin can be measured by the following method.

Gel permeation chromatography (GPC) equipment: GPC-8220GPC (manufactured by Tosoh Corporation)

Column: TSKgel SuperHZM-H, 15 cm, 3 columns (manufactured by Tosoh Corporation)

Temperature: 40° C.

Solvent: Tetrahydrofuran (THF)

Flow rate: 0.35 ml/min

Sample: Injection of 0.4 ml of a 0.15% by mass-sample

Sample pretreatment: A filtrate obtained by dissolving a toner in tetrahydrofuran (THF: manufactured by Wako Pure Chemical Industries, Ltd.) at 0.15% by mass and then filtrating the solution through a 0.2 μm filter is used as a sample solution.

For measurement, 100 μm of the sample solution is injected into the equipment. The molecular weight of the sample is found from its molecular weight distribution obtained from a relationship between the logarithmic values of a calibration curve prepared using several different concentrations of monodispersed polystyrene standard samples and count numbers (that is, the sample's molecular weight is calculated on a polystyrene's molecular weight basis). As the standard polystyrene samples for preparation of a calibration curve, Showdex STANDARDs of Std. Nos. S-7300, S-210, S-390, S-875, S-1980, S-10.9, S-629, S-3.0, and S-0.580 (manufactured by Showa Denko KK) are used in toluene. As the detector, an RI (refractive index) detector is used.

Although the silicone resin serving as a coating material of the second embodiment is not particularly limited and can be appropriately selected from generally-known silicone resins according to the purpose, for example, a straight silicone resin expressed by the above structural formula (i) is suitable.

In the structural formula (i), where R represents a methyl group or phenyl group, the straight silicone resin is called a methyl silicone resin or a phenyl silicon resin, respectively, and the methyl silicone resin is particularly preferable.

Although the weight-average molecular weight (Mw) of the silicone resin of the second embodiment is not particularly limited and can be appropriately selected according to the purpose, this is preferably 800 to 5,000, and more preferably, 1,000 to 4,000. When the weight-average molecular weight (Mw) is smaller than 800, the silicone resin may be inferior in strength as a coating resin, and when greater than 5,000, an insoluble content into a supercritical fluid is produced, which disables uniform coating onto the core surface.

A ratio (Mw/Mn) of the weight-average molecular weight (Mw) of the silicone resin of the second embodiment to a number-average molecular weight (Mn) is preferably 1.40 to 2.10. If the ratio (Mw/Mn) is less than 1.40, there is a possibility that durability decreases, whereas if the ratio is greater than 2.10, it results in the formation of insoluble content in a supercritical fluid, which may cause reduction in covering efficiency.

In addition, a ratio (R/S) of the weight R(g) of the silicone resin of the second embodiment to a surface area S($m^2$) of the core is within a range of 0.1 to 3.5. If the ratio (R/S) is less than 0.1, it may in result poor uniformity in the resultant coating to form carrier particles that are not fully covered with coating. If the ratio (R/S) is greater than 3.5, it may also result in poor uniformity in the resultant coating to form particles consisting only of cover resin that fails to cover core.

In addition, the silicon resins serving as coating resins in the first and second embodiments are preferably solid at 25° C. under normal pressure in terms of superiority in handling ability, film forming ability, and film thickness controllability rather than a liquid. Here, the normal pressure means a pressure in a standard state, which is 0.1 MPa in the present invention.

The silicone resins of the first and second embodiments preferably have a silanol concentration of 1% by mass to 40% by mass for crosslinking after film formation, more preferably, 1% by mass to 20% by mass, and still more preferably, 1% by mass to 10% by mass. When the silanol concentration is more than 40% by mass, a hard and fragile crosslinking film is easily produced, durability deteriorates, and unreacted silanol groups remain, so that environmental stability of the carrier may deteriorate. On the other hand, when the silanol concentration is less than 1% by mass, the silicone resin may be inferior in coating performance as coating resins.

As the silicone resins of the first and second embodiments, synthesized resins or commercially available products may be appropriately used. The commercially available products include straight silicone resins of KR271, KR255, KR220L, and KR152 manufactured by Shin-Etsu Chemical Co., Ltd., SR2400, SR2406, SR2410, SR213, 217 Flake Resin, 220 Flake Resin, 233 Flake Resin, 249 Flake Resin, and Z-6018 Intermediate manufactured by Dow Corning Toray Co., Ltd.

In addition, as the silicone resins of the first and second embodiments, modified silicone resins can also be used, and examples thereof include KR206 (alkyd modification), KR5208 (acrylic modification), ES1001N (epoxy modification), and KR305 (urethane modification) manufactured by Shin-Etsu Chemical Co., Ltd., SR2115 (epoxy modification), SR2110 (alkyd modification), SF8417, BY16-850, and BY16-872 (amino modification) by Dow Corning Toray Co., Ltd.

Here, although it is possible to use the silicone resin alone, it is also possible to use ingredients that undergo crosslinking reactions, charge amount adjusting ingredients or the like in combination. The ingredients that undergo crosslinking reactions are silane coupling agents and the like. Examples of the silane coupling agents include coupling agents of methyltrimethoxysilane, methyltriethoxysilane, octyltrimethoxysilane, and aminosilane.

As the aminosilane coupling agent, ones represented by the following formulae are suitable. The content of the aminosilane coupling agent is preferably 0.001% by mass to 30% by mass, and more preferably, 0.001% by mass to 15% by mass. The temporal stability of the carrier increases by the addition of an aminosilane coupling to the coating layer, whereby carrier durability is enhanced.

| | |
|---|---|
| $H_2N(CH_2)_3Si(OCH_3)_3$ | MW 179.3 |
| $H_2N(CH_2)_3Si(OC_2H_5)_3$ | MW 221.4 |
| $H_2NCH_2CH_2CH_2Si(CH_3)_2(OC_2H_5)$ | MW 161.3 |
| $H_2NCH_2CH_2CH_2Si(CH_3)(OC_2H_5)_2$ | MW 191.3 |
| $H_2NCH_2CH_2NHCH_2Si(OCH_3)_3$ | MW 194.3 |
| $H_2NCH_2CH_2NHCH_2CH_2CH_2Si(CH_3)(OCH_3)_2$ | MW 206.4 |
| $H_2NCH_2CH_2NHCH_2CH_2CH_2Si(OCH_3)_3$ | MW 224.4 |
| $(CH_3)_2NCH_2CH_2CH_2Si(CH_3)(OC_2H_5)_2$ | MW 219.4 |
| $(C_4H_9)_2NC_3H_6Si(OCH_3)_3$ | MW 291.6 |

—Fine Particle—

Fine particles can be added to the coating layer according to necessity. The fine particles are not particularly limited and can be appropriately selected from ones known as electrophotographic two-component carriers according to the purpose, and, for example, inorganic fine particles such as metal powders and various metal oxide particles are preferably used. Among these, for metal oxide particles of silicon oxide, titanium oxide, alumina, and the like, uniformly-sized, small-diameter particles can be readily obtained, and various electrical characteristics and mechanical strengths can be obtained depending on the particles used. Furthermore, in the course of condensation curing of the silicone resin, it is also important that the fine particles be thermally stable even when the carrier is heated to a high temperature.

In addition, for the purpose of adjusting electrical resistance, the coating layer can contain fine particles of a metal powder of conductive ZnO, Al, and the like, $SnO_2$ prepared by various methods or $SnO_2$ doped with various elements, borides (for example, $TlB_2$, $ZnB_2$, and $MoB_2$), silicon carbide, electroconductive polymers (for example, polyacetylene, polyparaphenylene, poly(para-phenylenesulfide), polypyrrole, parylene, and the like), carbon black and the like.

The amount of addition of the fine particles is preferably 1 part by mass to 100 parts by mass, and more preferably 1 part by mass to 70 parts by mass per 100 parts by mass of the coating resin.

Silicone resin that is most suitable for the coating layer is high in its electrical resistance and is generally known to be highly resistant. Therefore, it is preferable to use, as a resistance adjuster for resistance in the coating layer, at least one type of particles whose volume resistance is $10^{-6}$ Ω·cm or less. It is important for such conductive fine particles to have a sufficiently small particle diameter relative to the coating layer and be able to uniformly disperse within the coating layer. This is important, as it is not preferable to disrupt the undulation of the coating layer by introduction of these conductive fine particles, for unifying the charging ability by the coating layer topology and make toner holding and developing abilities exhibit expected effects. Materials that satisfy such requirements are metal oxide fine particles provided with conductivity, carbon black, and the like.

In addition, when a substance having an extremely low resistance such as carbon black is used by dispersion in the coating layer, since electrical characteristics of the coating layer fluctuate sensitively to the carbon black content, the coating layer requires careful handling. This involves difficulty in handling such that, for example, nonuniformity in electrical resistance between the carriers easily occurs, and characteristics of the carriers obtained are hard to stabilize to a slight process fluctuation in the manufacturing process. Although this can be avoided by correctly managing the carbon black content and unifying dispersibility within the coating layer, electrical resistance control material to be contained in the coating layer may use conductive carbon particles and fine particles of a nonconductive metal oxide by mixture.

—Core—

The core is not particularly limited and any core can be appropriately selected from ones known as electrophotographic two-component carriers according to the purpose, and, suitable examples thereof include ferrite, magnetite, iron, and nickel. In addition, with increasing considerations for the environment in recent years, it is suitable to use, in the case of ferrites, for example, Mn ferrites, Mn—Mg ferrites, Mn—Mg—Sr ferrites, and the like, rather than conventional copper-zinc ferrites.

As the core, one having a volume-average particle diameter of 20 μm or more is preferable in terms of prevention of carrier adhesion (scattering) to a latent electrostatic image bearing member, one having a volume-average particle diameter of 100 μm or less is preferable in terms of prevention of degradation in image quality such as prevention of carrier lines, and in particular, for a movement in image quality in recent years, one having a volume-average particle diameter of 20 μm to 50 μm is more preferable.

Here, the volume-average particle diameter of the core can be measured, for example, by use of a "Microtrac Particle-Size Analyzer SRA" manufactured by Nikkiso Co., Ltd. with a range setting of 0.7 μm to 125 μm.

It is preferable that the carriers obtained have, when used as a two-component developer, LogR of a measured electrical resistance value of 7 Ω·cm to 16 Ω·cm. The electrical resistance can be appropriately selected according to the developing process using the carriers, and when LogR is less than 7 Ω·cm, the rising shape of a brush (magnetic brush) of the carriers held on a developer support becomes conspicuous as shading of image density, and when LogR is more than 16 Ω·cm, problems may easily occur, such as a decline in developing performance due to edge development or carrier charge-up, possibly causing a difference in density between the edge portion and solid portion of an image or a difference in density between a line image and a solid image, and carrier development (carrier adhesion) to a non-image part of a latent image.

Here, electrical resistance of the carriers is a value determined from amperage and applied voltage when, for example, carriers are filled between two parallel electrodes and a potential difference is provided between the electrodes. Concretely, carriers are filled in a container having electrodes arranged parallel at an interval of 2 mm, and a direct current resistance at a potential difference of 50V between both electrodes is measured by a 4329A High Resistance Meter manufactured by Yokogawa Hewlett Packard Co., Ltd.

In addition, it is preferable to appropriately set the thickness of a coating layer of the carrier so that the electrical resistance is within a proper range; however, silicone has volume contraction at the time of contraction reaction and therefore has a drawback that the thicker the thickness of the coating layer becomes, the more easily nonuniformity of reaction inside the coating layer occurs. Therefore, the thickness of the coating layer is preferably 1.0 μm or less, and more preferably, 0.02 μm 0.8 μm.

Here, the thickness of the coating layer can be measured by, for example, observing a carrier section using a transmission electron microscope (TEM).

An apparatus for manufacturing the carriers is not particularly limited and can be appropriately set according to the purpose. Suitable examples thereof include an apparatus including at least a pressure-resistant container for dissolving or dispersing a coating resin therein and a pressure pump that feeds the supercritical fluid. As a processing method using the apparatus, first, at least a coating resin is charged in the pressure-resistant container, the supercritical fluid is fed into the pressure-resistant container by the pressure pump, and the supercritical fluid is made to contact with the coating resin to form a coating layer on the core surface. Then, when the pressure of the supercritical fluid is restored to a normal temperature and a normal pressure, the supercritical fluid is gasified, and thus not only does it become unnecessary to remove the solvent but also waste water caused by washing is eliminated, so that environmental loads are reduced.

Although the condition used for injecting fine particles or precursors thereof into a coating layer of the core surface is not particularly limited as long as it is at a critical pressure or more of the supercritical fluid or the subcritical fluid used and any condition can be appropriately selected according to the purpose, the pressure is preferably 1 MPa to 60 MPa.

Although the pressure when forming a coating layer on the core surface is not particularly limited as long as it is a critical pressure or more of the supercritical fluid or the subcritical fluid used and any pressure can be appropriately selected according to the purpose, this is preferably 1 MPa to 60 Mpa, and more preferably 5 MPa to 40 MPa.

Although the temperature when forming a coating layer on the core surface is not particularly limited as long as it is a critical temperature or more of the supercritical fluid or the subcritical fluid used and can be appropriately selected according to the purpose, this is preferably 35° C. to 90° C. when carbon dioxide is used, for example.

By the carrier manufacturing method of the present invention, a coating layer can be formed on the core surface by use of, for example, an apparatus shown in FIG. 1.

In order to concretely describe the method with reference to FIG. 1, a coating resin and cores are charged in a carrier treatment tank 251 and stirred, while a valve 252 is opened to feed carbon dioxide by a pressure pump 253 from a carbon dioxide cylinder 261 to make the interior reach 25 MPa and 40° C., and then the valve 252 is closed. After maintaining the interior of the carrier treatment tank 251 at 25 MPa and 80° C. for two hours, a valve 254 and a valve 255 are opened, and the pressure is restored by a pressure-reducing pump 256 to normal pressure over two hours. Furthermore, the carrier treatment tank 251 is heated at 160° C. for two hours, whereby carriers can be manufactured. In addition, it may be possible to feed an entrainer by a pressure pump 258 from an entrainer tank 257 according to necessity, and then close a valve 259 and a valve 260.

Here, reference numeral 262 denotes a raw-material recovery tank, 263 denotes a cooling jacket, 264 denotes a temperature control jacket, 265 denotes a rotator, and 266 denotes a stirrer in FIG. 1.

(Developer)

The developer of the present invention is a two-component developer containing the carrier of the present invention and toner.

The toner and carrier are preferably contained in the developer in amounts of 1.0 part by mass to 10.0 parts by mass of toner to 100 parts by mass of carrier.

The toner contains at least a binder resin and a colorant, and also contains a releasing agent, a charge control agent, and other components according to necessity.

<Toner>

A manufacturing method for the toner is not particularly limited, any manufacturing method can be appropriately selected according to the purpose, and examples thereof include a pulverization method and a suspension polymerization method, an emulsion polymerization method, and a polymer suspension method for forming toner base particles by emulsifying, suspending or flocculating an oil phase in an aqueous medium. Among these, a pulverization method is particularly preferable.

—Binder Resin—

The bonding resin is not particularly limited and can be appropriately selected from ones known according to the purpose. Examples thereof include homopolymers of styrene or substitution products of styrene such as polystyrene, poly-p-styrene, and polyvinyltoluene; styrene copolymers such as stylene-p-chlorostyrene copolymers, styrene-propylene copolymers, styrene-vinyltoluene copolymers, styrene-methyl acrylate polymer copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-methyl α-chlormethacrylate copolymers, styrene-acrylonitrile copolymers, styrene-vinylmethylether copolymers, styrene-vinylmethylketone copolymers, styrene-butadiene copolymers, styrene-isopropyl copolymers, and styrene-maleic ester copolymers; polymethylmethacrylate resins, polybutylmethacrylate resins, polyvinyl chloride resins, polyvinyl acetate resins, polyethylene resins, polyester resins, polyurethane resins, epoxy resins, polyvinylbutyral resins, polyacrylic resins, rosin resins, modified rosin resins, terpene resins, phenol resins, aliphatic hydrocarbon resins, aromatic hydrocarbon resins, and aromatic petroleum resins. These may be used alone or in combination of two or more.

—Colorant—

The colorant is not particularly limited, and any colorant can be appropriately selected from known dyes and pigments according to the purpose. Examples thereof include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, vermilion lead, cadmium red, cadmium mercury red, antimony vermilion, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These may be used alone or in combination of two or more.

The content of the colorant in the toner is preferably from 1% by mass to 15% by mass, and more preferably, 3% by mass to 10% by mass.

The colorant may be used as a master batch being combined with a resin. The resin is not particularly limited, and any resin may be appropriately selected from known colorants according to the purpose. Examples thereof include polymers of styrene or substituted styrenes, styrene copolymers, polymethyl methacrylate resins, polybuthyl methacrylate resins, polyvinyl chloride resins, polyvinyl acetate resins, polyethylene resins, polypropylene resins, polyester resins, epoxy resins, epoxy polyol resins, polyurethanes, polyamides, polyvinyl butyrals, polyacrylic resins, rosins, modified rosins, terpene resins, aliphatic hydrocarbon resins, alicyclic hydrocarbon resins, aromatic petroleum resins, chlorinated paraffin, and paraffin. These may be used alone or in combination of two or more.

—Releasing Agent—

The releasing agent is not particularly limited, and can be appropriately selected from known releasing agents according to the purpose. Suitable examples thereof include waxes.

Examples of the waxes include carbonyl group-containing waxes, polyolefin waxes, and long-chain hydrocarbons. These may be used alone or in combination of two or more. Among these, carbonyl group-containing waxes are preferable.

The carbonyl group-containing waxes include, for example, polyalkanoic acid esters, polyalkanol esters, polyalkanoic acid amides, polyalkyl amides, and dialkyl ketones.

The polyalkanoic acid esters include, for example, carnauba wax, montan wax, trimethylolpropane tribehenate, pentaerythritol tetrabehenate, pentaerythritol diacetate dibehenate, glycerin tribehenate, 1,18-octadecanediol distearate and the like. The polyalkanol esters include, for example, tristearyl trimellitate, and distearyl maleate. The polyalkanoic acid amides include, for example, dibehenyl amide. The polyalkyl amides include, for example, tristearylamide trimellitate. The dialkyl ketones include, for example, distearyl ketone. Among these carbonyl group-containing waxes, polyalkanoic acid esters are particularly preferable.

The polyolefin waxes include, for example, polyethylene waxes, and polypropylene waxes.

The long-chain hydrocarbons include, for example, paraffin waxes, and Sasol Wax.

Although the melting point of the releasing agent is not particularly limited and can be appropriately selected according to the purpose, this is preferably 40° C. to 160° C., more preferably, 50° C. to 120° C., and most preferably, 60° C. to 90° C.

When the melting point is less than 40° C., the wax may adversely affect heat-resisting preservability, and when the melting point is more than 160° C., it is liable to cause cold offset at the time of fixing at low temperature.

The melt viscosity of the releasing agent is preferably 5 cps to 1,000 cps, and more preferably, 10 cps to 100 cps as a measurement at a temperature higher by 20° C. than the melting point of the wax.

When the melt viscosity is less than 5 cps, releasability may deteriorate, and when the melt viscosity is more than 1,000 cps, enhancing effects on hot-offset resistance and low-temperature fixing ability may not be obtained.

Although the content of the releasing agent in the toner is not particularly limited and can be appropriately selected according to the purpose, this is preferably 1% by mass to 40% by mass, and more preferably, 3% by mass to 30% by mass.

When the content is more than 40% by mass, fluidity of the toner may deteriorate.

—Charge Control Agent—

The charge control agent is not particularly limited, and a positive or negative charge control agent can be appropriately selected and used according to the polarity of charge on the photoconductor.

As the negative charge control agent, for example, resins or compounds having electron-donating functional groups, azo dyes, organometallic complexes, and the like can be used. Concretely, examples thereof include BONTRON (product number: S-31, S-32, S-34, S-36, S-37, S-39, S-40, S-44, E-81, E-82, E-84, E-86, E-88, A, 1-A, 2-A, 3-A) (all manufactured by Orient Chemical Industries, Ltd.), KAYACHARGE (product number: N-1, N-2), KAYASET BLACK (product number: T-2, 004) (all manufactured by Nippon Kayaku Co., Ltd.); AIZEN SPILON BLACK (T-37, T-77, T-95, TRH, TNS-2) (all manufactured by HODOGAYA CHEMICAL CO., LTD.); and FCA-1001-N, FCA-1001-NB, and FCA-1001-NZ (all manufactured by Fujikura Kasei Co., Ltd.).

Examples of the positive charge control agent include basic compounds such as nigrosine dyes, cationic compounds such as quaternary ammonium salts, metal salts of higher fatty acids, and the like can be used. Concretely, BONTRON (product number: N-01, N-02, N-03, N-04, N-05, N-07, N-09, N-10, N-11, N-13, P-51, P-52, AFP-B) (all manufactured by Orient Chemical Industries, Ltd.); TP-302, TP-415, TP-4040 (all manufactured by HODOGAYA CHEMICAL CO., LTD.); Copy Blue PR, Copy Charge (product number: PX-VP-435, NX-VP-434) (all manufactured by Hoechst AG); FCA (product number: 201, 201-B-1, 201-B-2, 201-B-3, 201-PB, 201-PZ, 301) (all manufactured by Fujikura Kasei Co., Ltd.); and PLZ (product number: 1001, 2001, 6001, 7001) (all manufactured by SHIKOKU CHEMICALS CORPORATION). These may be used alone or in combination of two or more.

Although the amount of addition of the charge control agent is determined depending on the toner manufacturing method including the type and dispersing method of the binder resin, and is not uniquely limited, this is preferably 0.1 parts by mass to 10 parts by mass, and more preferably, 0.2 parts by mass to 5 parts by mass, per 100 parts by mass of the binder resin. When the amount of addition is more than 10 parts by mass, the charging ability of the toner is excessively great, which reduces the effect of the charge control agent, the electrostatic attracting force with the developing roller increases, which may cause a decline in fluidity of the developer and a decline in image density. When the amount of addition is less than 0.1 parts by mass, the charge rising ability and the amount of charge are insufficient, which is liable to affect the toner image.

It is possible to add, to the toner materials, inorganic fine particles, a fluidity improver, a cleanability improver, a magnetic material, a metal soap, and the like besides the binder resin, the releasing agent, the colorant, and the charge control agent.

As the inorganic fine particles, for example, silica, titania, alumina, cerium oxide, strontium titanate, calcium carbonate, magnesium carbonate, calcium phosphate, and the like can be used, and it is more preferable to use silica fine particles hydrophobized by silicone oil or hexamethyldisilazane and titanium oxide applied with a specific surface treatment.

As the silica fine particles, for example, AEROSIL (product number: 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, REA200) (all manufactured by NIPPON AEROSIL CO., LTD.), HDK (product number: H20, H2000, H3004, H2000/4, H2050EP, H2015EP, H3050EP, KHD50), HVK2150 (all manufactured by Wacker Chemical AG), CAB-O-SIL (product number: L-90, LM-130, LM-150, M-5, PTG, MS-55, H-5, HS-5, EH-5, LM-150D, M-7D, MS-75D, TS-720, TS-610, TS-530) (all manufactured by Cabot Corporation), and the like can be used.

The amount of addition of the inorganic fine particles is preferably 0.1 parts by mass to 5.0 parts by mass, and more preferably, 0.8 parts by mass to 3.2 parts by mass, per 100 parts by mass of toner base particles.

A method for manufacturing the toner is not particularly limited and can be appropriately selected according to the purpose; examples thereof include a pulverization method, a polymerization method (a suspension polymerization method, an emulsion polymerization method) for directly polymerizing specific crystalline macromolecules and monomer compositions containing polymerizable monomers in an aqueous phase, a polyaddition reaction method for directly elongating or crosslinking specific crystalline macromolecules and compositions containing isocyanate group-containing prepolymers in an aqueous phase by amines, a polyaddition reaction method using isocyanate group-containing prepolymers, a method for dissolving by a solvent and removing the solvent for pulverization, and a melt spray method.

The pulverization method is a method for obtaining base particles of the toner by, for example, melting or kneading, pulverizing, and classifying toner materials. In the pulverization method, for the purpose of improving average circularity of the toner, mechanical impacts may be applied to the obtained toner base particles to control the shapes. In this case, the mechanical impacts can be applied to the toner base particles by use of, for example, an apparatus such as a hybridizer or a mechanofusion system.

The above toner materials are mixed, and the mixture is charged in a melt kneader for melt kneading. As the melt kneader, for example, a single-screw continuous kneader, a twin-screw continuous kneader, or a batch kneader by a roll mill can be used. For example, a twin-screw extruder Model KTK manufactured by Kobe Steel, Ltd., an extruder Model TEM manufactured by Toshiba Machine Co., Ltd., a twin-screw extruder manufactured by KCK, Co., Ltd., a twin-screw extruder Model PCM manufactured by Ikegai Iron Works, Ltd., Ko-Kneader manufactured by Buss AG, or the like is suitably used. It is preferable to carry out this melt kneading under proper conditions so as not to cause a molecular chain breaking of the binder resin. Concretely, the melt kneading is carried out at a temperature with reference to a softening point of the binder resin, severe breaking may occur when the temperature is excessively higher than the softening point, and dispersion may not progress when the temperature is excessively low.

In the pulverization, the kneaded mixture obtained by the kneading is pulverized. It is preferable to first coarsely pulverize and then finely pulverize the kneaded mixture. In this case, preferably used are pulverization methods such as pulverization by making the kneaded mixture collide with a collision plate in a jet stream, pulverization by making particles collide with each other in a jet stream, and pulverization in a narrow gap between a mechanically rotating rotor and a stator.

In the classification, the pulverized mixtures obtained from the pulverization are classified and adjusted into particles having a predetermined particle diameter. The classification can be carried out by removing fine particle parts by, for example, cyclone separation, decantation, centrifugal separation, or the like.

After completion of the pulverization and classification, the pulverized mixtures are classified in an air stream by a centrifugal force and the like to manufacture toner particles having a predetermined particle diameter.

In the suspension polymerization method, a colorant, a releasing agent, and the like are dispersed in an oil-soluble polymerization initiator and polymerizable monomers, and these are emulsified by an emulsification method to be described later in an aqueous medium containing a surfactant and other agents such as a solid dispersing agent. Then, after a polymerization reaction to produce particles, a wet process may be performed for adhering inorganic fine particles to the toner particle surfaces in the present invention. At that time, it is preferable to apply the process to toner particles from which an excessive surfactant and the like has been removed by washing.

As the polymerizable monomers, partially using, for example, acids such as acrylic acid, methacrylic acid, α-cyanoacrylic acid, α-cyanomethacrylic acid, itaconic acid, crotonic acid, fumaric acid, maleic acid, and maleic anhydride; acrylamide, methacrylamide, diacetoneacrylamide, and methylol compounds thereof, acrylates and methacrylates having amino groups, such as vinylpyridine, vinylpyrrolidone, vinylimidazole, ethyleneimine, and dimethylaminoethyl methacrylate makes it possible to introduce functional groups to the toner particle surfaces.

In addition, functional groups can be introduced by selecting, as the dispersing agent used, one having acidic groups or basic groups and thereby the dispersing agent is made to absorb and remain on the particle surfaces.

In the emulsion polymerization method, a water-soluble polymerization initiator and polymerizable monomers are emulsified in water using a surfactant, and latex is synthesized by a general method for emulsion polymerization. Separately, a colorant, a releasing agent, and the like are dispersed in an aqueous medium to prepare a dispersion, the dispersion is mixed, and the latex particles are then aggregated into a toner particle size, heated, and fusion-bonded to one another to produce toner particles. Subsequently, a wet process of inorganic fine particles to be described later may be performed. Functional groups can be introduced to the toner particle surfaces by using monomers similar to those used for the suspension polymerization method as latex.

Among these, because of high selectivity of resins, high low-temperature fixing ability, excellent granulation ability, and easiness in controlling particle diameter, particle size distribution, and shapes, suitably used as the toner is one obtained by preparing a toner solution by dissolving or dispersing, in an organic solvent, a toner material containing active hydrogen group-containing compounds and polymers capable of reacting with the active hydrogen group-containing compounds, and then preparing a dispersion by emulsifying or dispersing, in an aqueous solution, the toner solution, making, in the aqueous medium, the active hydrogen group-containing compounds react with polymers capable of reacting with the active hydrogen group-containing compounds to produce an adhesive base material in particulate forms, and removing the organic solvent.

The toner material contains at least an adhesive base material obtained by reacting together an active hydrogen group-containing compound, a polymer capable of reacting with the active hydrogen group-containing compound, a binder resin, a charge control agent, and a colorant, and further contains other components such as resin fine particles, and a releasing agent as necessary.

In addition, in order to improve fluidity, preservability, developability, and transferability of the toner, the thus manufactured toner base particles can be added and mixed with inorganic particles such as hydrophobic silica fine powder. Although a common powder mixer is used to mix an additive, it is preferable to equip a jacket or the like to adjust the temperature inside. Here, in order to change the history of a stress applied to the additive, the additive may be added in the middle or gradually. In this case, the number of revolutions, rolling speed, time, temperature, and the like of the mixer may be changed. Alternatively, first, a strong stress and then a relatively weak stress may be added, and vice versa. Examples of available mixing equipment include a V-form mixer, a ROCKING MIXER, a LOEDIGE MIXER, a NAUTA MIXER, and a HENSCHEL MIXER. Next, coarse particles and aggregated particles are removed by sieving with a screen of 250 mesh or more, and thus a toner can be obtained.

Although the toner is not particularly limited in terms of the shape and size thereof and can be appropriately selected according to the purpose, it is preferable to have the following average circularity, volume-average particle diameter, ratio between the volume-average particle diameter and number-average particle diameter (volume-average particle diameter/number-average particle diameter), and the like.

The average circularity is a value obtained by dividing a perimeter of an equivalent circle equal in the projected area to the toner shape by a perimeter of a real particle, and this is preferably 0.900 to 0.980, and more preferably, 0.950 to 0.975, for example. One containing particles having an average circularity of less than 0.94 at 15% or less is preferable.

When the average circularity is less than 0.900, satisfactory transferability and a high quality image without dust may not be obtained, and when this is more than 0.980, in an image forming system employing blade cleaning or the like, there is a possibility that a cleaning defect occurs on the photoconductor, transfer belt, and the like to cause image smears, for example, in the case of formation of an image with a high image area ratio such as a photographic image, background smears as a result of toner that has formed an image untransferred due to a paper feed defect and the like being accumulated as a residual untransferred toner on the photoconductor or to contaminate the charge roller that contact-charges the photoconductor to disable the charge roller from exhibiting original charging ability.

The average circularity was measured by use of a flow-type particle image analyzer ("FPIA-2100," manufactured by SYSMEX CORPORATION) and analyzed by use of analysis software (FPIA-2100 Data Processing Program for FPIA version 00-10). Specifically, in a 100 ml glass beaker, 0.1 ml to 0.5 ml of a 10% by mass surfactant (alkylbenzene sulfonate, NEOGEN SC-A, manufactured by Daiichi Kogyo Seiyaku Co., Ltd.) was placed, then 0.1 g to 0.5 g of each of the toners was added and stirred with a microspatula, and then 80 ml of ion exchange water was added. The thus obtained dispersion was dispersed in an ultrasonic dispersing machine (manufactured by Honda Electronics Co., Ltd.) for 3 minutes. The shape and distribution of the toner of the dispersion were measured by use of the analyzer FPIA-2100 until a concentration of 5,000 to 15,000 particles/μl was obtained. In the present measuring method, controlling the dispersion concentration to 5,000 to 15,000 particles/μl is important from the point of measurement reproducibility of average circularity. In order to obtain the dispersion concentration, it is necessary to change the conditions of the dispersion, that is, the amount of the surfactant and the amount of the toner to be added. Similar to the measurement of the toner particle diameter described above, the requirement of the surfactant differs depending on hydrophobicity of the toner, noise due to bubbles occurs when a large amount of the surfactant is added, while it is impossible to sufficiently moisten the toner when the amount is small, and thus dispersion is insufficient. In addition, the amount of addition of the toner differs depending on the particle diameter, the amount is small with a small particle diameter, while it is necessary to increase the amount with a large particle diameter, and when the toner particle diameter is 3 μm to 10 μm, it becomes possible to adjust the dispersion concentration to 5,000 to 15,000 particles/μl by adding the toner by 0.1 g to 0.5 g.

Although the volume-average particle diameter of the toner is not particularly limited and can be appropriately selected according to the purpose, this is preferably 3 μm to 10 μm, and more preferably, 3 μm to 8 μm, for example.

When the volume-average particle diameter is less than 3 μm, with a two-component developer, the toner may be fusion-boded to the surfaces of carriers as a result of a long-term stirring in a developing device, which deteriorates charging ability of the carriers, and when this is more than 10 μm, it becomes difficult to obtain a high resolution, high quality image, and the particle diameter of the toner may greatly fluctuate when the toner is consumed and replenished in the developer.

The ratio of the volume-average particle diameter and the number-average particle diameter (volume-average particle diameter/number-average particle diameter) in the toner is preferably 1.00 to 1.25, and more preferably, 1.10 to 1.25.

The volume-average particle diameter and the ratio of the volume-average particle diameter and the number-average particle diameter (volume-average particle diameter/number-average particle diameter) were measured at an aperture diameter of 100 μm by use of a particle size analyzer ("MULTISIZER III," manufactured by Beckman Coulter, Inc.), and were analyzed by analysis software (BECKMAN COULTER MULTISIZER 3 Version 3.51). Specifically, in a 100 ml glass beaker, 0.5 ml of a 10% by mass surfactant (alkylbenzene sulfonate, NEOGEN SC-A, manufactured by Daiichi Kogyo Seiyaku Co., Ltd.) was placed, then 0.5 g of each of the toners was added thereto and stirred with a microspatula, and then 80 ml of ion exchange water was added. The thus obtained dispersion was dispersed in an ultrasonic dispersing machine (W-113MK-II, manufactured by Honda Electronics Co., Ltd.) for 10 minutes. Using ISOTON III (manufactured by Beckman Coulter, Inc.) as a solution for measurement, properties of the dispersion were measured by use of the MULTISIZER III. The measurement was performed by dropping the toner sample dispersion such that the concentration thereof indicated by the analyzer reaches 8±2%. In the present measuring method, controlling the concentration of the toner sample dispersion to 8±2% is important from the point of measurement reproducibility of the particle diameter. Within this concentration range, no particle diameter variations occur.

Coloring of the toner is not particularly limited and can be appropriately selected according to the purpose. This can be provided as at least one selected from a black toner, a cyan toner, a magenta toner, and a yellow toner. Although the respective color toners can be obtained by appropriately selecting the types of the colorants, a color toner is preferable.

<Developer Container>

The developer container is a container that contains the developer of the present invention.

The container is not particularly limited, and can be appropriately selected from generally-known containers according to the purpose. Suitable examples thereof include a container having a developer container body and a cap.

The developer container body is not particularly limited in size, shape, structure, material, and the like, and can be appropriately selected according to the purpose. For example, the shape is preferably a cylindrical shape and the like, and particularly preferably one having spiral projections and depressions formed at the inner circumferential surface, allowing a toner as the contents to move to an ejection opening side by being rotated, and having a bellows function at a part or the whole of the spiral parts.

The material of the developer container body is not particularly limited, and one excellent in dimensional accuracy is preferable. Suitable example include resins, and among these, suitable resin examples include a polyester resin, a polyethylene resin, a polypropylene resin, a polystyrene resin, a polyvinylchloride resin, a polyacrylate resin, a polycarbonate resin, an ABS resin, a polyacetal resin, and the like.

The developer container is easily preserved and conveyed, is excellent in handling ability, and can be suitably used to feed a developer while being detachably attached to the process cartridge and the image forming apparatus and the like of the present invention to be described later.

(Process Cartridge)

A process cartridge used in the present invention includes at least a latent electrostatic image bearing member that supports a latent electrostatic image and a developing unit that develops a latent electrostatic image bearing membered on the latent electrostatic image bearing member with a developer to form a visible image, and further includes other units appropriately selected according to necessity.

The developing unit includes at least a developer container that contains the developer of the present invention and a developer support that supports and conveys the developer contained in the developer container, and may further include a layer thickness control member that controls the thickness of a toner layer to be supported according to necessity.

The process cartridge of the present invention can be detachably equipped in various image forming apparatuses employing electrophotography, and is preferably detachably equipped in the image forming apparatus of the present invention to be described later.

Figure 2:
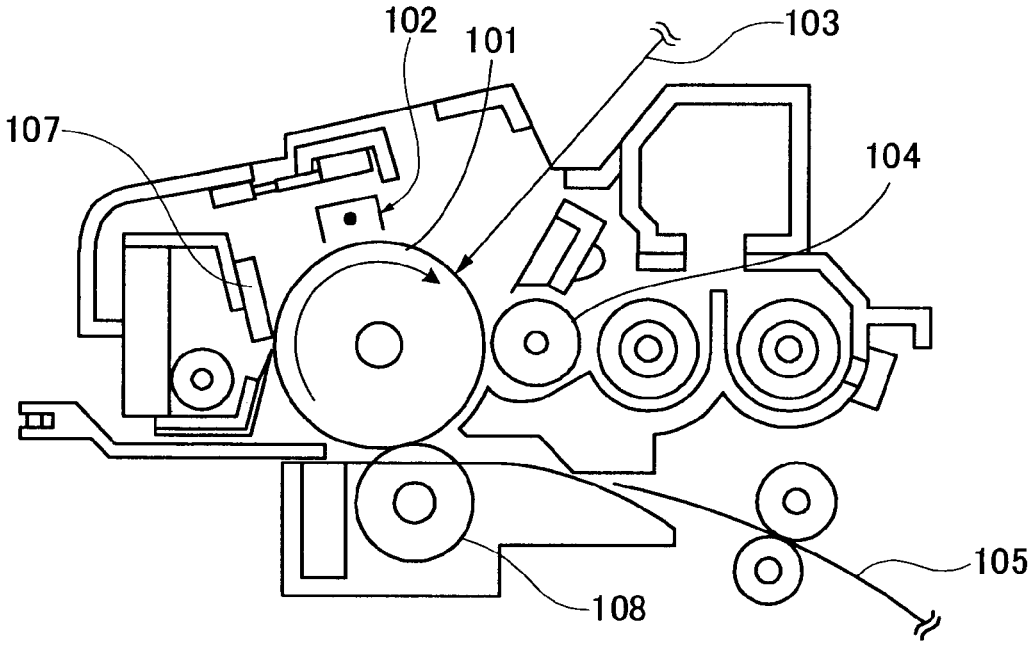
FIG. 2 is a schematic configuration view showing an example of a process cartridge used in the present invention.

Here, the process cartridge, for example, as shown in FIG. 2, incorporates a photoconductor 101, includes a charging unit 102, a developing unit 104, a transfer unit 108, and a cleaning unit 107, and further includes other members according to necessity. Reference numeral 103 in FIG. 2 denotes exposure by an exposing unit, for which a light source capable of writing at a high resolution is used. Reference numeral 105 denotes a recording medium. As the photoconductor 101, one the same as that of the image forming apparatus to be described later can be used. For the charging unit 102, any charging member can be used.

Next, an image forming process conducted by the process cartridge of FIG. 2 will be described. The photoconductor 101, while rotating in the arrow direction, bears on its surface a latent electrostatic image corresponding to an exposure image by charging by the charging unit 102 and exposure 103 by the exposing unit (unillustrated). This latent electrostatic image is toner-developed by the developing unit 104, and the developed toner image is transferred by the transfer unit 108 to the recording medium 105 and is printed. Subsequently, the photoconductor surface after an image transfer is cleaned by the cleaning unit 107, is further discharged by a decharging unit (unillustrated), and the above operations are repeated.

(Image Forming Method and Image Forming Apparatus)

An image forming method used in the present invention includes at least a latent electrostatic image forming step, a developing step, a transferring step, and a fixing step, and further includes other steps, for example, a decharging step, a cleaning step, a recycling step, a control step, and the like, appropriately selected according to necessity.

An image forming apparatus used in the present invention includes at least a latent electrostatic image bearing member, a latent electrostatic image forming unit, a developing unit, a transferring unit, and a fixing unit, and further includes other units, for example, a decharging unit, a cleaning unit, a recycling unit, a control unit, and the like, appropriately selected according to necessity.

The latent electrostatic image forming step is a step of forming a latent electrostatic image on the latent electrostatic image bearing member.

The latent electrostatic image bearing member (sometimes referred to as "electrophotographic photoconductor" or "photoconductor") is not particularly limited in material, shape, structure, size, and the like, and can be appropriately selected from known ones. The shape is suitably a drum shape, and examples of the material include amorphous silicon and selenium of inorganic photoconductors and polysilane and phthalopolymethine of organic photoconductors (OPCs). Among these, amorphous silicon or the like is preferable from the point of a long life span.

The latent electrostatic image can be formed by, for example, uniformly charging the surface of the latent electrostatic image bearing member and then exposing the surface imagewise, and this can be carried out by the latent electrostatic image forming unit. The latent electrostatic image forming unit includes at least, for example, a charger that uniformly charges the surface of the latent electrostatic image bearing member and an exposurer that exposes the surface of the latent electrostatic image bearing member imagewise.

The charging can be carried out by, for example, applying voltage to the surface of the latent electrostatic image bearing member by use of the charger.

Although the charger is not particularly limited and can be appropriately selected according to the purpose, examples thereof include a contact charger which is known by itself provided with a conductive or semiconductive roll, brush, film, rubber blade, or the like, and a noncontact charger using a corona discharge such as a corotron or scorotron.

As the charger, preferred is one that is arranged in contact or out of contact with the latent electrostatic image bearing member and charges the surface of the latent electrostatic image bearing member by being superposedly applied with direct current and alternating current voltages.

In addition, the charger is preferably a charging roller that is arranged in proximity out of contact with the latent electrostatic image bearing member via a gap tape and charges the surface of the latent electrostatic image bearing member as a result of being superposedly applied with direct current and alternating current voltages to the charging roller.

The exposure can be carried out by, for example, exposing the surface of the latent electrostatic image bearing member imagewise by use of the exposurer.

Although the exposurer is not particularly limited as long as it is capable of exposing in a form of an image to be formed on the surface of the latent electrostatic image bearing member charged by the charger and can be appropriately selected according to the purpose, examples thereof include various exposurers such as a copying optical system, a rod lens array system, a laser optical system, and a liquid crystal shutter optical system.

Here, in the present invention, a backlight system for exposing the latent electrostatic image bearing member imagewise from the rear surface side may be employed.

—Developing Step and Developing Unit—

The developing step is a step of developing the latent electrostatic image by use of the developer to form a visible image.

The visible image can be formed by, for example, developing the latent electrostatic image by use of the developer of the present invention, and this can be carried out by the developing unit.

The developing unit is not particularly limited, for example, as long as it is capable of developing by use of the developer of the present invention and can be appropriately selected from known ones. For example, one that includes at least a developing device that contains the developer of the present invention and is capable of applying the developer to the latent electrostatic image in a contact or noncontact manner is suitable, and a developing device with the developer container is more preferable.

The developing device can employ either a dry developing system or a wet developing system, and can be either a single-color developing device or a multi-color developing device, and suitable examples thereof include one including a stirrer that frictionally stirs the developer so as to be charged and a rotatable magnet roller.

In the developing device, for example, the toner and the carriers are mixed and stirred, the toner is charged by friction at that time and is held in a rising state on the surface of the rotating magnet roller to form a magnetic brush. Since the magnet roller is arranged in the vicinity of the latent electrostatic image bearing member (photoconductor), a part of the toner held in the magnetic brush formed on the surface of the magnet roller is moved to the surface of the latent electrostatic image bearing member (photoconductor) by an electrical suction force. As a result, the latent electrostatic image is developed with the toner to form a visible image of the toner on the surface of the latent electrostatic image (photoconductor).

The developing device contains the developer of the present invention.

—Transferring Step and Transfer Unit—

The transferring step is a step of transferring the visible image to a recording medium. It is preferable to use an intermediate transfer member, primarily transfer a visible image onto the intermediate transfer member, and then secondarily transfer the visible image onto the recording medium, and it is more preferable that the transferring step includes a primary transfer step of transferring a visible image onto an intermediate transfer member to form a complex transfer image by use of, as the toner, toners of two or more colors, preferably, full-color toners, and a secondary transfer step of transferring the compound transfer image onto a recording medium.

The transfer is carried out by, for example, charging the visible image onto the latent electrostatic image bearing member (photoconductor) by use of a transfer charger, and this can be carried out by the transfer unit. The transfer unit preferably includes a primary transfer unit that transfers a visible image onto an intermediate transfer member to form a compound transfer image and a secondary transfer unit that transfers the compound transfer image onto a recording medium.

Here, the intermediate transfer member is not particularly limited and can be appropriately selected from known transfer members according to the purpose, and suitable examples include a transfer belt.

The transfer unit (the primary transfer unit and the secondary transferring unit) preferably includes at least a transfer device that peels and charges the visible image formed on the latent electrostatic image bearing member (photoconductor) onto the recording medium side. One or a plurality of transfer units can be provided.

Examples of the transfer device include a corona transfer device using corona discharge, a transfer belt, a transfer roller, a pressure transfer roller, and an adhesion transfer device.

Here, the recording medium is not particularly limited and can be appropriately selected from known recording media (recording paper).

The fixing step is a step of fixing a visible image transferred onto a recording medium by use of a fixing device, and this may be carried out for respective color developers every time these are transferred to the recording medium or may be simultaneously carried out for respective color developers in a laminated state at a time.

Although the fixing device is not particularly limited and can be appropriately selected according to the purpose, a known heating pressure unit is suitable. Examples of the heating pressure unit include a combination of a heating roller and a pressure roller and a combination of a heating roller, a pressure roller, and an endless belt.

The fixing device is preferably a unit that includes a heater with a heating element, a film that contacts with the heater, and a pressure member that pressure-contacts with the heater via the film and makes a recording medium with an unfixed image formed pass through between the film and the pressure member for heat-fixing. Usually, heating by the heating pressure unit is preferably at 80° C. to 200° C.

Here, in the present invention, for example, a known optical fixing device may be used in combination with the fixing step and fixing unit or in place of these.

The decharging step is a step of decharging by applying a decharging bias to the latent electrostatic image bearing member, and this can be suitably carried out by a decharging unit.

The decharging unit is not particularly limited, is satisfactory as long as it is capable of applying a decharging bias to the latent electrostatic image bearing member, and can be appropriately selected from known dechargers. Suitable examples include decharging lamps.

The cleaning step is a step of removing the toner remaining on the latent electrostatic image bearing member, and this can be suitably carried out by a cleaning unit.

The cleaning unit is not particularly limited, and is satisfactory as long as it is capable of removing the toner remaining on the latent electrostatic image bearing member, and can be appropriately selected from known cleaners. Suitable examples include a magnetic brush cleaner, an electrostatic brush cleaner, a magnetic roller cleaner, a blade cleaner, a brush cleaner, and a web cleaner.

The recycling step is a step of making the developing unit recycle the toner removed by the cleaning step, which can be suitably carried out by a recycling unit.

The recycling unit is not particularly limited, and this can be a known conveying unit, or the like.

The control step is a step of controlling the respective steps, and the respective steps can be suitably controlled by a control unit.

The control unit is not particularly limited as long as it is capable of controlling operations of the respective units, and can be appropriately selected according to the purpose. Examples thereof include such devices as sequencers and computers.

An aspect of the image forming method of the present invention will be described with reference to FIG. 3. An image forming apparatus 100 shown in FIG. 3 includes a photoconductor drum 10 (hereinafter, referred to as "photoconductor 10") serving as the latent electrostatic image bearing member, a charging roller 20 serving as the charging unit, an exposing device 30 serving as the exposing unit, a developing device 40 serving as the developing unit, an intermediate transfer member 50, a cleaning device 60 serving as the cleaning unit having a cleaning blade, and a decharging lamp 70 serving as the decharging unit.

The intermediate transfer member 50 is an endless belt, which is designed so as to be movable in the arrow direction by three rollers 51 that are arranged inside and support the same. A part of the three rollers 51 also functions as a transfer bias roller that is capable of applying a predetermined transfer bias (primary transfer bias) to the intermediate transfer member 50. For the intermediate transfer member 50, arranged in the vicinity thereof is a cleaning device 90 having a cleaning blade, and arranged opposing thereto is a transfer roller 80 serving as the transfer unit capable of applying a transfer bias to transfer (secondary transfer) a developed image (toner image) onto a transfer sheet 95 serving as a final transfer material. Around the intermediate transfer medium 50, arranged is a corona charger 58 for imparting a charge to the toner image on the intermediate transfer medium 50, in the rotating direction of the intermediate transfer member 50, between a contact portion between the photoconductor 10 and the intermediate transfer member 50 and a contact portion between the intermediate transfer member 50 and the transfer sheet 95.

The developing device 40 is composed of a developing belt 41 serving as the developer carrier and a black development unit 45K, a yellow development unit 45Y, a magenta development unit 45M, and a cyan development unit 45C provided side by side around the developing belt 41. Here, the black development unit 45K includes a developer containing portion 42K, a developer feed roller 43K, and a developing roller 44K, the yellow development unit 45Y includes a developer containing portion 42Y, a developer feed roller 43Y, and a developing roller 44Y, the magenta development unit 45M includes a developer containing portion 42M, a developer feed roller 43M, and a developing roller 44M, and the cyan development unit 45C includes a developer containing portion 42C, a developer feed roller 43C, and a developing roller 44C. In addition, the developing belt 41 is an endless belt, which is rotatably stretched around a plurality of belt rollers and a part of which contacts with the photoconductor 10.

Figure 3:
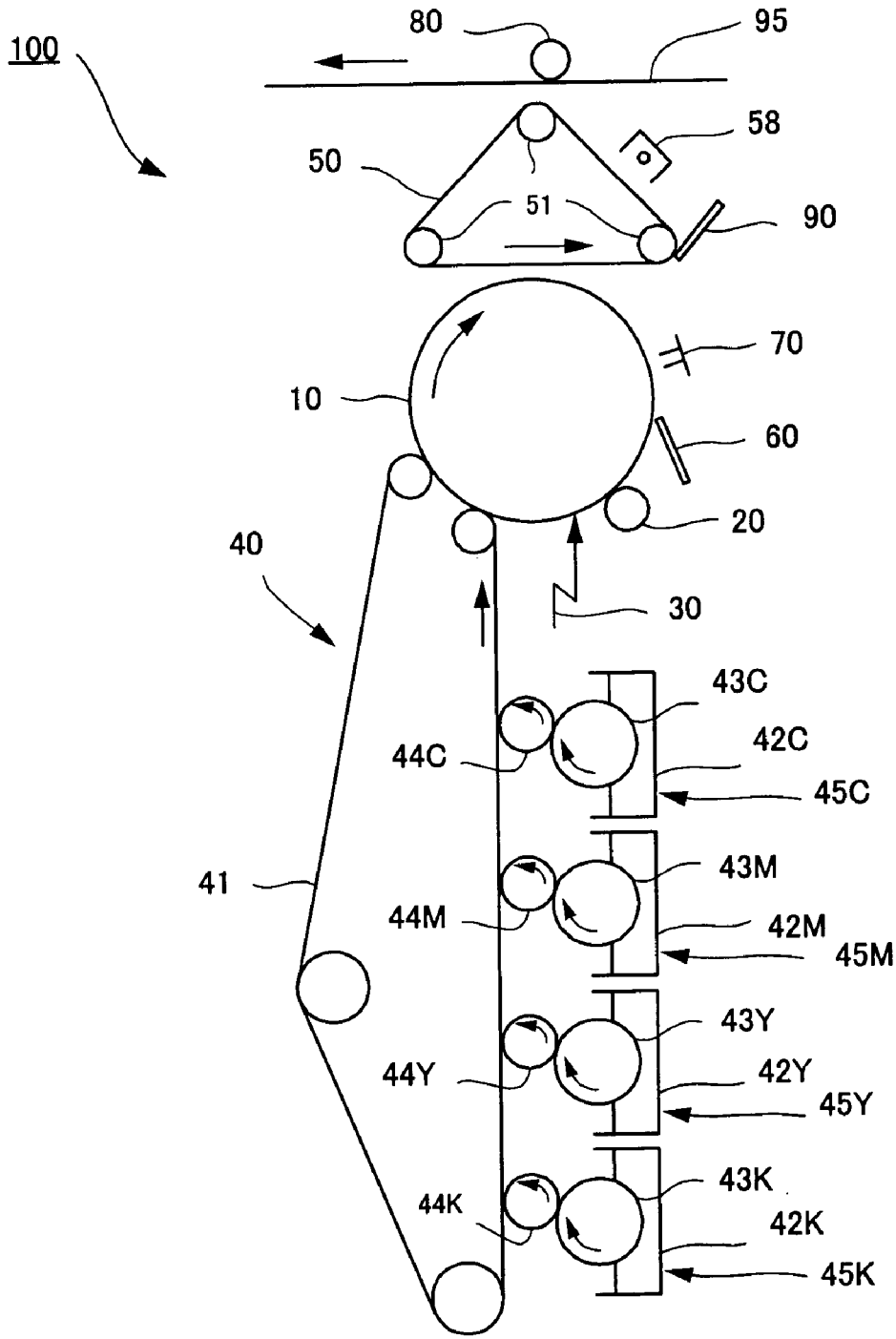
FIG. 3 is a schematic explanatory view showing an example to carry out an image forming method by an image forming apparatus used in the present invention.

In the image forming apparatus 100 shown in FIG. 3, for example, the charging roller 20 uniformly charges the photoconductor drum 10. The exposing device 30 carries out exposure imagewise on the photoconductor drum 10 to form a latent electrostatic image. The latent electrostatic image formed on the photoconductor drum 10 is developed by feeding a toner from the developing device 40 to form a visible image (toner image). The visible image (toner image) is transferred (primary transfer) onto the intermediate transfer medium 50 by a voltage applied from the rollers 51 and is further transferred (secondary transfer) onto the transfer sheet 95. As a result, a transfer image is formed on the transfer sheet 95. Here, a residual toner on the photoconductor 10 is removed by the cleaning device 60, and charging on the photoconductor 10 is once removed by the decharging lamp 70.

Figure 4:
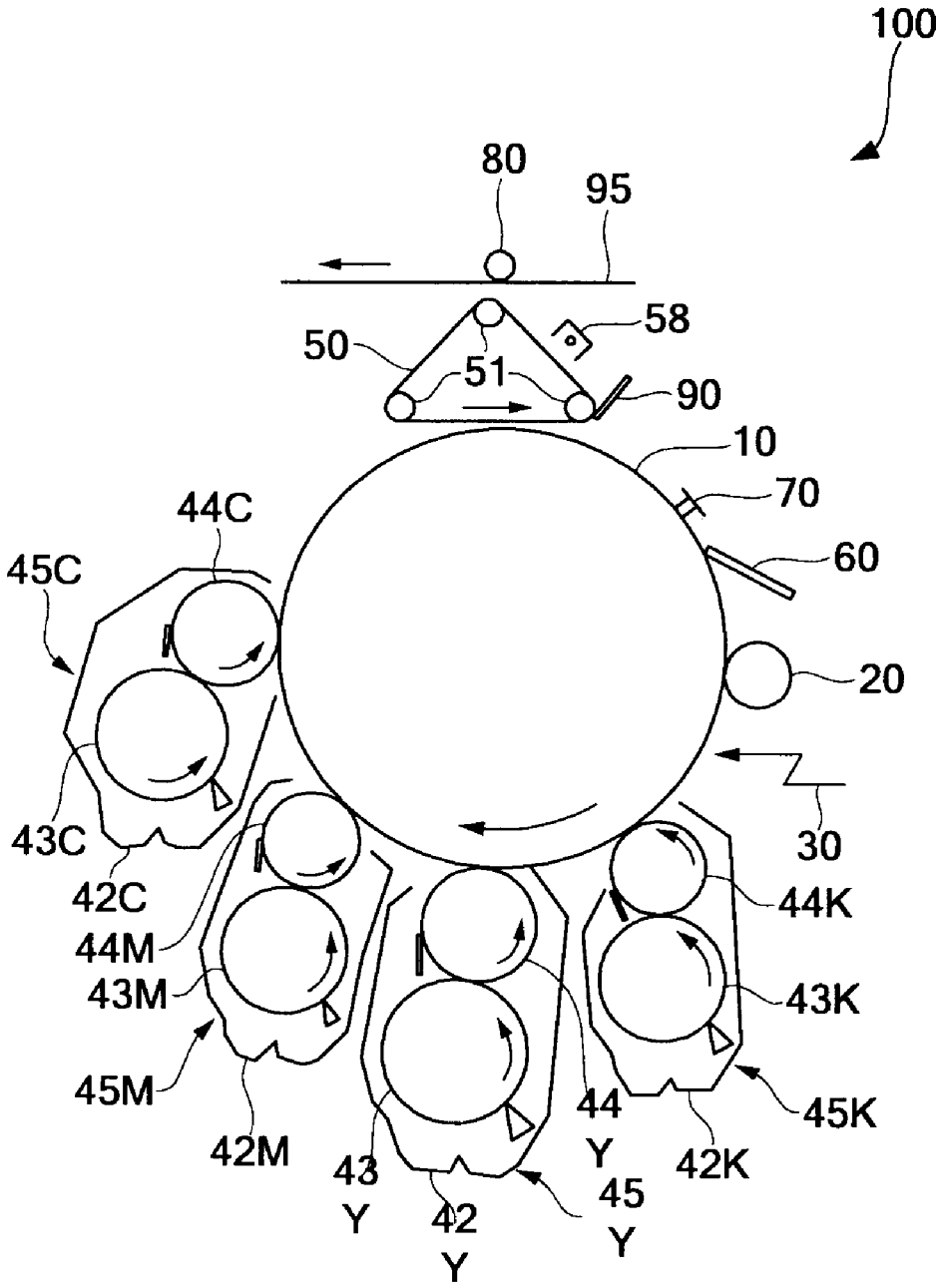
FIG. 4 is a schematic explanatory view showing another example to carry out an image forming method by an image forming apparatus used in the present invention.

Another aspect for carrying out the image forming method of the present invention by an image forming apparatus of the present invention will be described with reference to FIG. 4. An image forming apparatus 100 shown in FIG. 4 has the same configuration as that of the image forming apparatus 100 shown in FIG. 3 except that, in the image forming apparatus 100 shown in FIG. 3, no developing belt 41 is provided and a black development unit 45K, a yellow development unit 45Y, a magenta development unit 45M, and a cyan development unit 45C are arranged around the photoconductor 10 in a directly opposing manner, and exhibits the same actions and effects. In FIG. 4, the same components as those in FIG. 3 are denoted with the same reference numerals.

Figure 5:
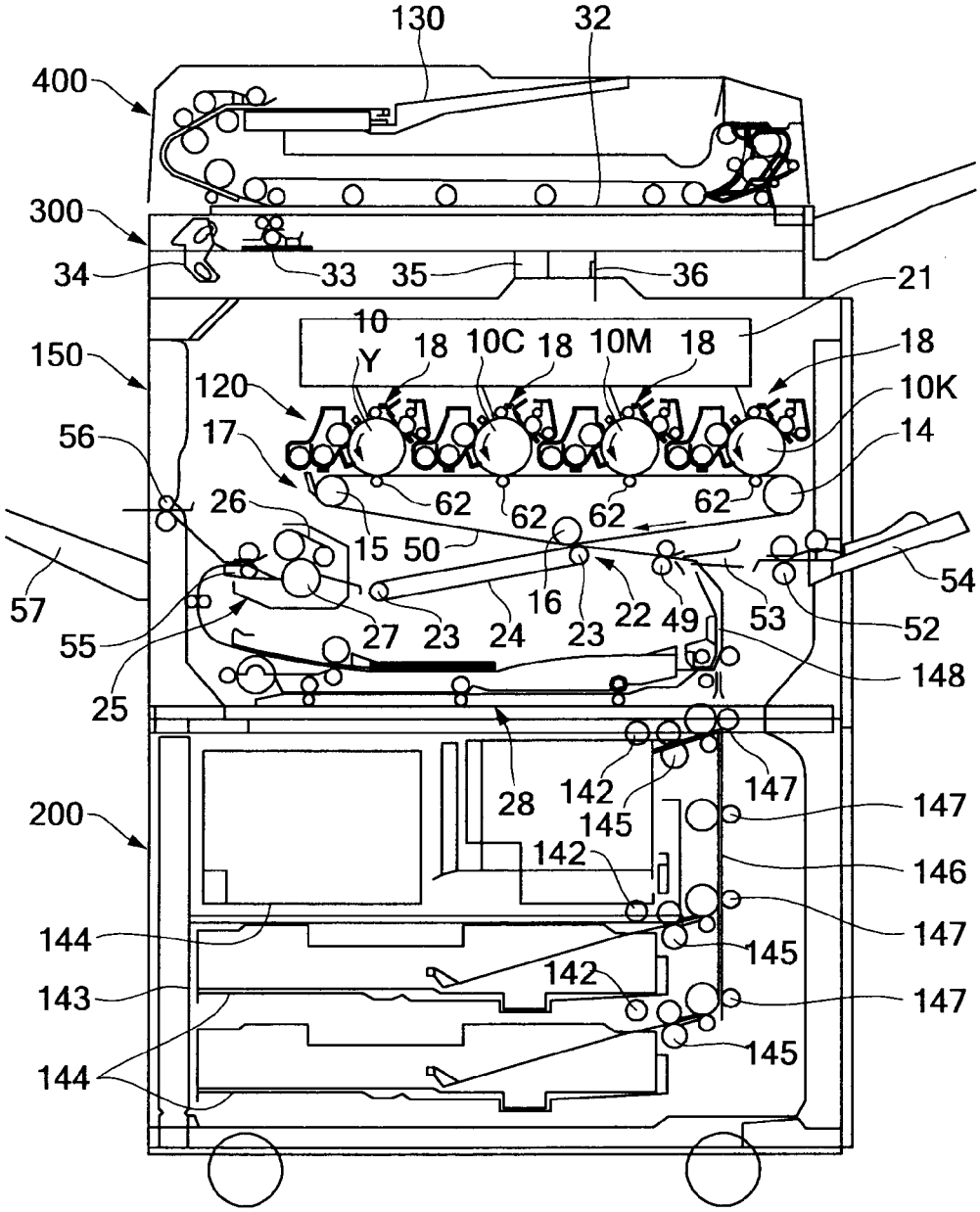
FIG. 5 is a schematic explanatory view showing an example to carry out an image forming method by an image forming apparatus (tandem type color image forming apparatus) used in the present invention.

Another aspect for carrying out the image forming method of the present invention by an image forming apparatus of the present invention will be described with reference to FIG. 5. A tandem image forming apparatus shown in FIG. 5 is a tandem-type color image forming apparatus. The tandem image forming apparatus includes a copier body 150, a paper feed table 200, a scanner 300, and an automatic document feeder (ADF) 400.

In the copier body 150, an endless belt-like intermediate transfer medium 50 is provided at the center portion. The intermediate transfer member 50 is stretched around support rollers 14, 15, and 16 and is made rotatable clockwise in FIG. 5. In the vicinity of the support roller 15, arranged is an intermediate transfer member cleaning device 17 for removing a residual toner on the intermediate transfer member 50. On the intermediate transfer member 50 stretched by the support roller 14 and the support roller 15, arranged along its conveying direction is a tandem-type developing device 120 for which four yellow, cyan, magenta, and black image forming units 18 are juxtaposed in an opposing manner. In the vicinity of the tandem-type developing device 120, arranged is an exposing device 21. On the side of the intermediate transfer member 50 opposite the side where the tandem-type developing device 120 is arranged, a secondary transferring device 22 is arranged. In the secondary transferring device 22, a secondary transfer belt 24 serving as an endless belt is stretched across a pair of rollers 23, and a transfer sheet and the intermediate transfer member 50 conveyed on the secondary transfer belt 24 can contact each other. In the vicinity of the secondary transferring device 22, arranged is a fixing device 25. The fixing device 25 includes a fixing belt 26 serving as an endless belt and a pressure roller 27 arranged while being pressed thereagainst.

Here, in the tandem image forming apparatus, arranged in the vicinity of the secondary transfer device 22 and the fixing device 25 is a sheet reversing device 28 for reversing a transfer sheet in order to form images on both surfaces of the transfer sheet.

Next, formation of a full-color image (color copy) using the tandem-type developing device 120 will be described. That is, first, a document is set on a document table 130 of the automatic document feeder (ADF) 400, or the automatic document feeder 400 is opened and a document is set on a contact glass 32 of the scanner 300, and then the automatic document feeder 400 is closed.

When a start switch (unillustrated) is pressed, the scanner 300 is driven, when the document has been set on the automatic document feeder 400, after the document is conveyed and moved onto the contact glass 32; on the other hand, when the document has been set on the contact glass 32, the scanner 300 is immediately driven. And a first traveler 33 and a second traveler 34 travel. At this time, by the first traveler 33, light from a light source is irradiated while a reflected light from the document surface is reflected by a mirror of the second traveler 34, the light is received by a reading sensor 36 through an imaging lens 35, and thus the color document (color image) is read as black, yellow, magenta, and cyan image information.

Figure 6:
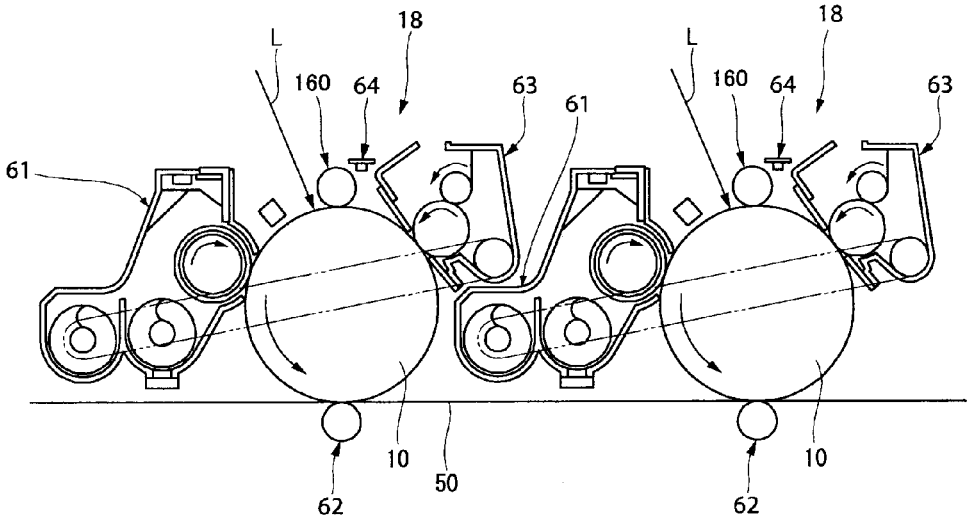
FIG. 6 is a partially enlarged schematic explanatory view of the image forming apparatus shown in FIG. 5.

Then, the respective black, yellow, magenta, and cyan image information are transmitted to the respective image forming units 18 (black image forming unit, yellow image forming unit, magenta image forming unit, and cyan image forming unit) of the tandem-type developing device 120, respectively, and black, yellow, magenta, and cyan toner images are formed by the respective image forming units. That is, the respective image forming units 18 (black image forming unit, yellow image forming unit, magenta image forming unit, and cyan image forming unit) of the tandem-type developing device 120 include, as shown in FIG. 6, photoconductors 10 (black photoconductor 10K, yellow photoconductor 10Y, magenta photoconductor 10M, and cyan photoconductor 10C), chargers 160 that uniformly charge the photoconductors, exposurers that expose ("L" in FIG. 6) the photoconductors in a form of an image corresponding to respective color images based on the respective color image information and thereby form latent electrostatic images corresponding to the respective color images on the photoconductors, developing devices 61 that develop the latent electrostatic images with respective color toners (black toner, yellow toner, magenta toner, and cyan toner) to form toner images by the respective color toners, transfer chargers 62 that transfer the toner images onto the intermediate transfer member 50, photoconductor cleaning devices 63, and dechargers 64, respectively, and are capable of forming the respective single-color images (black image, yellow image, magenta image, and cyan image) based on the respective color image information. For the thus formed black image, yellow image, magenta image, and cyan image, a black image formed on the black photoconductor 10K, a yellow image formed on the yellow photoconductor 10Y, a magenta image formed on the magenta photoconductor 10M, and a cyan image formed on the cyan photoconductor 10C are respectively transferred (primary transfer) in sequence onto the intermediate transfer member 50 rotationally moved by the support rollers 14, 15, and 16. Then, the black image, the yellow image, the magenta image, and the cyan image are superimposed on the intermediate transfer member 50 to form a composite color image (color transfer image).

On the other hand, in the paper feed table 200, one of the paper feed rollers 142 is selectively rotated to let sheets (recording paper) out from one of the paper feed cassettes 144 provided in multiple tiers in a paper bank 143, and the sheets are separated by a separation roller 145 and separately sent out to a paper feed path 146, are conveyed by a conveyance roller 147 and guided to a paper feed path 148 within the copier body 150, and are made to hit against a resist roller 49 and stopped. Alternatively, the paper feed roller 142 is rotated to let sheets (recording paper) on a manual feed tray 54 through rollers 52, and the sheets are separated by the separation roller 145 and separately fed into a manual paper feed path 53, and are similarly made to hit against the resist roller 49 and stopped. Here, the resist roller 49 is generally used grounded, but it may be used in a state where a bias is applied for paper powder removal of the sheets. Then, the resist roller 49 is rotated in timing with the composite color image (color transfer image) formed on the intermediate transfer member 50 to send out the sheet (recording paper) between the intermediate transfer member 50 and the secondary transfer unit 22, and by transferring (secondary transfer) the composite color image (color transfer image) onto the sheet (recording paper), a color image is transferred and formed on the sheet (recording paper). Here, the residual toner on the intermediate transfer member 50 after the image transfer is cleaned by the intermediate transfer member cleaning device 17.

The sheet (recording paper) on which a color image is transferred and formed is conveyed by the secondary transferring device 22 and sent out to the fixing device 25, and in the fixing device 25, the composite color image (color transfer image) is fixed onto the sheet (recording paper) by heat and pressure. Then, the sheet (recording paper) is switched by a switching claw 55, is discharged by a discharge roller 56, and is stacked on a discharged paper tray 57, or the sheet (recording paper) is switched by the switching claw 55, is reversed by the sheet reversing device 28, is guided again to the transfer position for recording an image on the rear surface as well, and then is discharged by the discharge roller 56 and is stacked on the discharged paper tray 57.

In the image forming apparatus and image forming method of the present invention, since a developer containing the carrier of the present invention that is high in mechanical strength and is capable of forming an image free from toner scattering and background smears is used, a high-quality image can be efficiently formed.

According to the present invention, various conventional problems can be solved, and a carrier manufacturing method capable of obtaining coated carrier particles having a coating layer with a structure having a moderate concentration gradient without an interface in the coating layer, and capable of manufacturing a stable carrier that is high in durability, can form an image free from toner scattering and background smears and high in image density, and never causes deterioration in charging characteristics even when the carrier coating layer wears down during continuous use; a carrier manufactured by using the carrier manufacturing method; a developer capable of forming an image free from toner scattering and background smears and high in image density using the carrier; and a process cartridge, image forming apparatus and image forming method using the developer can be provided.

Furthermore, a carrier can be efficiently formed while meeting the volatile organic compound (VOC) regulations, producing no liquid waste, and requiring little drying energy.

EXAMPLES

Hereinafter, Examples of the present invention will be described, which however shall not be construed as limiting the scope of the present invention.

Preparation Example 1

Preparation of Toner 1

One hundred parts by mass of a polyester resin (weight-average molecular weight=12,000), 2 parts by mass of a copper phthalocyanine pigment, and 2 parts by mass of a charge control agent represented by the following structural formula (A) (iodine salt of nonylene perfluoroether p-trimethylaminopropyl amidophenyl) were kneaded at 120° C. by a heat roll, cooled to solidify, and then pulverized and classified to obtain toner base particles with a volume-average particle diameter of 7.1 μm, a number-average particle diameter of 5.8 μm, and an average circularity of 0.953.

Structural Formula (A)

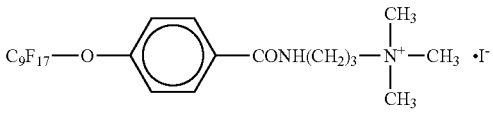

Next, to 100 parts by mass of the obtained toner base particles, 0.5 parts by mass of silica R972 (manufactured by NIPPON AEROSIL CO., LTD.) was added and mixed to prepare "Toner 1."

Preparation Example 2

Preparation of Toner 2

One hundred parts by mass of a polyester resin (weight-average molecular weight=12,000), 5 parts by mass of carbon black, and 2 parts by mass of a chromium-containing azo dye represented by the following structural formula (B) were kneaded at 120° C. by a heat roll, cooled to solidify, and then pulverized and classified to obtain toner base particles with a volume-average particle diameter of 7.3 μm, a number-average particle diameter of 6.0 μm, and an average circularity of 0.955.

Structural Formula (B)

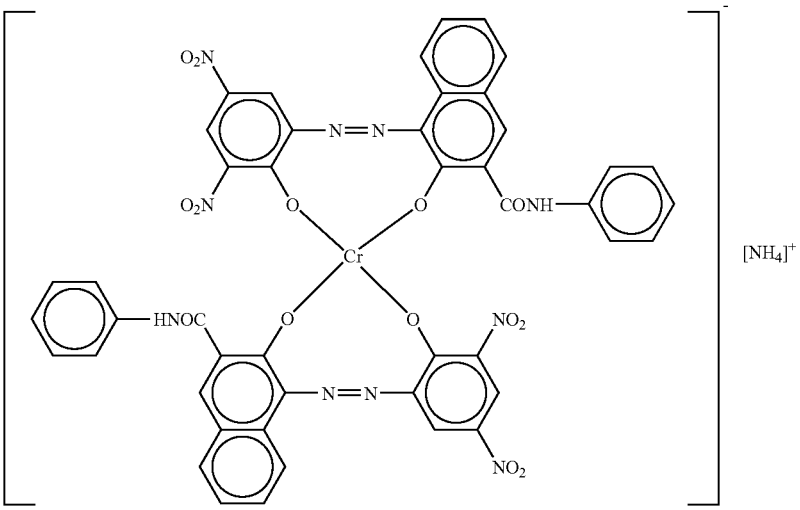

Next, to 100 parts by mass of the obtained toner base particles, 0.5 parts by mass of silica R972 (manufactured by NIPPON AEROSIL CO., LTD.) was added and mixed to prepare "Toner 2."

Preparation Example 3

Preparation of Toner 3

—Synthesis of Organic Fine Particle Emulsion—

In a reaction vessel set with a stirring rod and a thermometer, 683 parts by mass of water, 11 parts by mass of a sodium salt of sulfate ester of ethylene oxide adduct of methacrylic acid (ELEMINOL RS-30, Sanyo Chemical Industries, Ltd.), 83 parts by mass of styrene, 83 parts by mass of methacrylic acid, 110 parts by mass of butyl acrylate, and 1 part by mass of ammonium persulfate were charged, and stirred at 400 rpm for 15 minutes to obtain a white emulsion. This emulsion was heated to a temperature of 75° C. and reacted for 5 hours. Next, 30 parts by mass of a 1% by mass aqueous solution of ammonium persulfate was added thereto and aged at 75° C. for 5 hours to obtain an aqueous dispersion of a vinyl resin (copolymer of methacrylic acid-butyl acrylate-sodium salt of sulfuric acid ester of ethylene oxide adduct of methacrylic acid). This aqueous dispersion is referred to as "Fine Particle Dispersion 1."

The obtained "Fine Particle Dispersion 1" had a volume-average particle diameter of 105 nm when measured by a laser scattering particle diameter distribution analyzer ("LA-920" manufactured by HORIBA, Ltd.). In addition, a part of "Fine Particle Dispersion 1" was dried to isolate only the resin component. This resin component had a glass transition temperature (Tg) of 59° C. and a weight-average molecular weight of 150,000.

—Preparation of Aqueous Phase—

990 parts by mass of water, 83 parts by mass of [Fine Particle Dispersion 1], 37 parts by mass of a 48.5% by mass aqueous solution of sodium dodecyl diphenyl ether disulfonate (ELEMINOL MON-7, Sanyo Chemical Industries, Ltd.), and 90 parts by mass of ethyl acetate were mixed and stirred to obtain a milky white liquid. This liquid is referred to as [Aqueous Phase 1].

—Synthesis of Low-Molecular Polyester—

In a reaction vessel equipped with a cooling tube, a stirrer, and a nitrogen introducing tube, 229 parts by mass of an ethylene oxide 2-mol adduct of bisphenol A, 529 parts by mass of a propylene oxide 3-mol adduct of bisphenol A, 208 parts by mass of terephthalic acid, 46 parts by mass of adipic acid, and 2 parts by mass of dibutyltin oxide were charged, the mixture was reacted under 230° C. under normal pressure for 8 hours and was further reacted under a reduced pressure of 10 mmHg to 15 mmHg for 5 hours, then 44 parts by mass of trimellitic anhydride was charged in the reaction vessel, and the mixture was reacted at 180° C. under normal pressure for 2 hours, whereby [Low-Molecular Polyester 1] was synthesized.

The obtained [Low-Molecular Polyester 1] had a glass-transition temperature (Tg) of 45° C., a weight-average molecular weight of 5,800, a number-average molecular weight of 2,600, and an acid value of 24 mgKOH/g.

—Synthesis of Polyester Prepolymer—

In a reaction vessel equipped with a cooling tube, a stirrer, and a nitrogen introducing tube, 682 parts by mass of ethylene oxide 2-mol adduct of bisphenol A, 81 parts by mass of a propylene oxide 2-mol adduct of bisphenol A, 283 parts by mass of terephthalic acid, 22 parts by mass of trimellitic anhydride, and 2 parts by mass of dibutyltin oxide was placed, and the mixture was reacted under 230° C. under normal pressure for 8 hours. Then, the mixture was further reacted under a reduced pressure of 10 mmHg to 15 mmHg for 5 hours, whereby [Intermediate Polyester 1] was synthesized.

The obtained [Intermediate Polyester 1] had a number-average molecular weight of 2,100, a weight-average molecular weight of 9,500, a glass transition temperature (Tg) of 55° C., an acid value of 0.5 mgKOH/g, and a hydroxyl value of 51 mgKOH/g.

Next, in a reaction vessel equipped with a cooling tube, a stirrer, and a nitrogen introducing tube, 410 parts by mass of [Intermediate Polyester 1], 89 parts by mass of isophorone diisocyanate, and 500 parts by mass of ethyl acetate were placed, and the mixture was reacted at 100° C. for 5 hours, whereby [Prepolymer 1] was obtained.

The obtained [Prepolymer 1] had a free isocyanate content of 1.74% by mass.

—Synthesis of Ketimine—

In a reaction vessel equipped with a stirring rod and a thermometer, 170 parts by mass of isophoronediamine and 75 parts by mass of methyl ethyl ketone were charged, and the mixture was reacted at 50° C. for 5 hours, whereby [Ketimine Compound 1] was synthesized. The obtained [Ketimine Compound 1] had an amine value of 418.

—Preparation of Master Batch (MB)—

1,200 parts by mass of water, 540 parts by mass of carbon black (PBk-7: PRINTEX 60, manufactured by Degussa AG, DBP oil absorbance: 114 ml/100 mg, pH: 10), and 1,200 parts by mass of a polyester resin (manufactured by Sanyo Chemical Industries, Ltd., RS801) were placed and mixed by HENSCHEL MIXER (manufactured by MITSUI MINING Co., Ltd.). The obtained mixture was kneaded at 150° C. for 30 minutes by a two-roll mill, then rolled and cooled, and pulverized by a pulverizer, whereby a master batch was obtained. This is referred to as [Master Batch 1.]

—Preparation of Oil Phase—

In a reaction vessel equipped with a stirring rod and a thermometer, 300 parts by mass of [Low-Molecular Polyester 1], 90 parts by mass of carnauba wax, 10 parts by mass of rice wax, and 1000 parts by mass of ethyl acetate were charged, the mixture was dissolved at 79° C. while being stirred, and then rapidly cooled to 4° C. The mixture was dispersed by a bead mill (ULTRAVISCOMILL, manufactured by Aimex Co., Ltd.) under the conditions of a liquid feeding speed of 1 kg/hr, a disk circumferential speed of 6 m/sec., and 3 times-pass through, with the mill being filled with 80% by volume of 0.5 mm-zirconia beads, whereby a wax dispersion having a volume-average particle diameter 0.6 μm was obtained.

Next, 500 parts by mass of [Master Batch 1] and 640 parts by mass of a 70% by mass of ethyl acetate solution of [Low-Molecular Polyester 1] were added and mixed for 10 hours, and then passed through the bead mill 5 times, and ethyl acetate was added to adjust the solid content concentration, whereby [Oil Phase 1] having a solid content concentration of 50% by mass is prepared.

—Preparation of Polymerized Toner—

73.2 parts by mass of [Oil Phase], 6.8 parts by mass of [Prepolymer 1], and 0.48 parts by mass of [Ketimine Compound 1] were placed in a container and sufficiently mixed. In the thus obtained [Emulsified Oil Phase 1], 120 parts by mass of [Aqueous Phase 1] was added and mixed by a homomixer for 1 minute, then the mixture was sheared while being slowly stirred with a paddle, whereby [Emulsified Slurry 1] was obtained.

The obtained [Emulsified Slurry 1] was de-solvented at 30° C. for 1 hour, further aged at 60° C. for 5 hours, and washed in water, filtrated, and dried, and then sieved with a mesh screen having an opening size of 75 μm, whereby toner base particles having a volume-average particle diameter of 6.1 μm, number-average particle diameter of 5.4 μm, and an average circularity of 0.972 were prepared.

Next, 0.7 parts by mass of hydrophobic silica and 0.3 parts by mass of hydrophobized titanium oxide were mixed into 100 parts by mass of the obtained toner base particles by HENSCHEL MIXER, whereby "Toner 3" was prepared.

Example A-1

Preparation of Carrier A1

By use of the apparatus shown in FIG. 1, in the carrier treatment tank (inner capacity 400 mL) 251, each 14 parts by mass of a 0.5 mol % amino-modified methyl silicone resin A (weight-average molecular weight=2,500, number-average molecular weight (Mn)=1,300), a 2 mol % amino-modified methyl silicone resin B (weight-average molecular weight (Mw)=2,600, number-average molecular weight (Mn)=1,400), a 5 mol % amino-modified methyl silicone resin C (weight-average molecular weight=2,400, number-average molecular weight (Mn)=1,300), an 8 mol % amino-modified methyl silicone resin D (weight-average molecular weight=2,500, number-average molecular weight (Mn)=1,400), and a 10 mol % amino-modified methyl silicone resin E (weight-average molecular weight (Mw)=2,300, number-average molecular weight (Mn)=1,200) and 1,000 parts by mass of ferrite cores (saturation magnetic moment at 1 k Gauss=65 emu/g) having a volume-average particle diameter of 35 μm (surface area 7.27 $m^2$) were charged and stirred, while the valve 252 was opened to feed carbon dioxide (purity=99.5%, produced by Gastec Service, Inc.) to make the tank interior reach 25 MPa and 40° C., and then the valve 252 was closed.

The solubilities of the amino-modified methyl silicone resins A to E to carbon dioxide were measured in the manner described below. The solubility of the amino-modified methyl silicone resin A was: determined to be 600 mg/mol-$CO_2$, the amino-modified methyl silicone resin B: 140 mg/mol-$CO_2$, the amino-modified methyl silicone resin C: 60 mg/mol-$CO_2$, the amino-modified methyl silicone resin D: 40 mg/mol-$CO_2$, and the amino-modified methyl silicone resin E: 30 mg/mol-$CO_2$.

<Solubility Measurement of Amino-Modified Methyl Silicone Resin>

By use of an apparatus where, of the apparatus shown in FIG. 1, the carrier treatment tank was changed to a solubility measurement tank having an inner capacity of 50 mL, solubility measurements were carried out under the following conditions.

Pressure: 25 MPa
Temperature: 40° C.
Fluid: Carbon dioxide
Flow rate: 3.0 ml/minute
Sample: 10 g The sample was placed in the solubility measurement tank, wherein carbon dioxide was circulated at the above pressure, temperature and flow rate for two hours. The amount of dissolution was calculated from the amount of a residual in the solubility measurement tank after circulation, and was provided as a solubility value.

After maintaining the interior of the carrier treatment tank 251 at 25 MPa and 40° C. for two hours, the valve 254 and valve 255 were opened, and the pressure was restored by the pressure-reducing pump 256 to a normal pressure in two hours. Furthermore, the carrier treatment tank 251 was heated at 160° C. for two hours. Here, unused amino-modified methyl silicone resins were successfully recovered from the raw-material recovery tank 262 for re-use.

The thickness of a coating layer of the Carrier A1 obtained was 0.35 μm, and electrical resistance measured in the manner described below was LogR=13.5 Ω·cm. In addition, when the sample was obliquely cut by a surface and interfacial cutting analysis system (SAICAS CN, manufactured by MEKONG CO., LTD.) and was observed by total-reflection measurement by use of a Fourier transform infrared spectrometer (SPECTRUM 100, manufactured by PerkinElmer, Inc.), it could be confirmed that there was no interface in the coating layer and a coating layer with a structure having a moderate concentration gradient made from the respective amino-modified methyl silicone resins could be obtained.

<Measurement of Carrier Electrical Resistance>

The electrical resistance of carriers is a value obtained from a current value and an applied voltage when carriers are filled between two parallel electrodes and a potential difference is provided between the electrodes. Concretely, carriers were filled in a container having electrodes arranged parallel at a distance of 2 mm, and a direct-current resistance at a potential difference of 50V between both electrodes was measured by use of a 4329A HIGH RESISTANCE METER manufactured by Yokogawa Hewlett Packard Co., Ltd.

Example A-2

Preparation of Carrier A2

Carrier A2 was prepared in the same manner as that of Example A-1 except that the resins used in Example A-1 were changed to a 0.5 mol % amino-modified methyl silicone resin A, a 2 mol % amino-modified methyl silicone resin B, a 5 mol % amino-modified methyl silicone resin C, and an 8 mol % amino-modified methyl silicone resin D (17.5 parts by mass each).

The thickness of a coating layer of the Carrier A2 obtained was 0.34 μm, and electrical resistance measured in the same manner as that of Example A-1 was LogR=13.5 Ω·cm. In addition, when the sample was observed in the same manner as that of Example A-1, it could be confirmed that there was no interface in the coating layer and a coating layer with a structure having a moderate concentration gradient made from the respective amino-modified methyl silicone resins could be obtained.

Example A-3

Preparation of Carrier A3

Carrier A3 was prepared in the same manner as that of Example A-1 except that the resins used in Example A-1 were changed to a 0.5 mol % amino-modified methyl silicone resin A, a 5 mol % amino-modified methyl silicone resin C, and a 10 mol % amino-modified methyl silicone resin E (23.3 parts by mass each).

The thickness of a coating layer of the Carrier A3 obtained was 0.34 μm, and electrical resistance measured in the same manner as that of Example A-1 was LogR=13.5 Ω·cm. In addition, when the sample was observed in the same manner as that of Example A-1, it could be confirmed that there was no interface in the coating layer and a coating layer with a structure having a moderate concentration gradient made from the respective amino-modified methyl silicone resins could be obtained.

Example A-4

Preparation of Carrier A4

Carrier A4 was prepared in the same manner as that of Example A-1 except that the resins used in Example A-1 were changed a 0.5 mol % amino-modified methyl silicone resin A, a 2 mol % amino-modified methyl silicone resin B, and a 5 mol % amino-modified methyl silicone resin C (23.3 parts by mass each).

The thickness of a coating layer of the Carrier A4 obtained was 0.36 μm, and electrical resistance measured in the same manner as that of Example A-1 was LogR=13.6 Ω·cm. In addition, when the sample was observed in the same manner as that of Example A-1, it could be confirmed that there was no interface in the coating layer and a coating layer with a structure having a moderate concentration gradient made from the respective amino-modified methyl silicone resins could be obtained.

Example A-5

Preparation of Carrier A5

Carrier A5 was prepared in the same manner as that of Example A-1 except that the resins used in Example A-1 were changed to a 0.5 mol % amino-modified methyl silicone resin A and a 2 mol % amino-modified methyl silicone resin B (35 parts by mass each).

The thickness of a coating layer of the Carrier A5 obtained was 0.35 μm, and electrical resistance measured in the same manner as that of Example A-1 was LogR=13.8 Ω·cm. In addition, when the sample was observed in the same manner as that of Example A-1, it could be confirmed that there was no interface in the coating layer and a coating layer with a structure having a moderate concentration gradient made from the respective amino-modified methyl silicone resins could be obtained.

Reference Example A-1

Preparation of Reference Carrier A1

Reference Carrier A1 was prepared in the same manner as that of Example A-1 except that the resins used in Example A-1 were changed to 70 parts by mass of a 0.5 mol % amino-modified methyl silicone resin A.

The thickness of a coating layer of the Reference Carrier A1 obtained was 0.35 μm, and electrical resistance measured in the same manner as that of Example A-1 was LogR=13.5 Ω·cm.

Comparative Example A-1

Preparation of Comparative Carrier A1

840 by mass of a toluene solution (solid content concentration of 10 parts by mass), prepared by dissolving in toluene 0.5 mol % amino-modified methyl silicone resin A, a 2 mol % amino-modified methyl silicone resin B, and a 5 mol % amino-modified methyl silicone resin C (28 parts by mass each), was applied to 1,000 parts by mass of ferrite cores (saturation magnetic moment at 1 k Gauss=63 emu/g) having a volume-average particle diameter of 35 μm by use of a fluidized-bed coating apparatus, under an ambient air of 100° C., at a rate of approximately 50 g/min over 20 minutes, and the obtained ferrite particles applied with the silicone resin were heated at 200° C. for one hour, whereby Comparative Carrier A1 was prepared.

The thickness of a coating layer of the obtained Comparative Carrier A1 was 0.35 μm, and electrical resistance measured in the same manner as that of Example A-1 was LogR=13.6 Ω·cm.

Comparative Example A2

Preparation of Comparative Carrier A2

280 parts by mass of a toluene solution A (solid content concentration: 10% by mass) prepared by dissolving 28 parts by mass of a 0.5 mol % amino-modified methyl silicone resin A in toluene, 280 parts by mass of a toluene solution B (solid content concentration: 10% by mass) prepared by dissolving 28 parts by mass of a 2 mol % amino-modified methyl silicone resin B in toluene, and 280 parts by mass of a toluene solution C (solid content concentration: 10% by mass) prepared by dissolving 28 parts by mass of a 5 mol % amino-modified methyl silicone resin C in toluene were prepared. To 1,000 parts by mass of ferrite cores (saturation magnetic moment at 1 k Gauss=63 emu/g) having a volume-average particle diameter of 35 μm, the amino-modified methyl silicone resin C, the amino-modified methyl silicone resin B, the amino-modified methyl silicone resin A were sequentially applied by use of a fluidized-bed coating apparatus, under an ambient air of 100° C., at a rate of approximately 50 g/min for approximately five minutes each, and the obtained ferrite particles applied with the silicone resins were heated at 200° C. for one hour, whereby Comparative Carrier A2 was prepared.

The thickness of the coating layer of the obtained Comparative Carrier A2 was 0.36 μm, and electrical resistance measured in the same manner as that of Example A-1 was LogR=13.5 Ω·cm.

Examples A-6 to A-12, Reference Example A-2, and Comparative Examples A-3 to A-5

Preparation of Developer

Using the prepared carriers A1 to A5, reference carriers A1, and comparative carriers A1 to A2 in combination with toners 1 to 3 as shown in the following Table A1, respective developers of Examples A-6 to A-12, Reference Example A-2, and Comparative Examples A-3 to A-6 were prepared by a conventional method.

By use of the obtained respective developers, evaluations of image density, toner scattering and background smears, and overall evaluations were conducted in the following manner. The results are shown in Table A1.

<Image Density>

With the obtained respective developers, by use of a tandem type color image forming apparatus (IMAGIO NEO 450, manufactured by Ricoh Co., LTD.), solid images with a deposited amount the respective developers of 1.00±0.05 mg/cm$^2$ were formed on sheets of copy paper (TYPE 6000 <70W>, manufactured by Ricoh Co., LTD.) The solid image formation was repeatedly carried out for 1,500,000 sheets of the copy paper.

The image density of the obtained solid images at the initial time and after printing of 1,500,000 sheets was visually observed and evaluated based on the following criteria. Here, the higher the obtained density is, an image of the higher density can be formed. This evaluation is equivalent to an example of a process cartridge, an image forming apparatus, and an image forming method used in the present invention.

[Evaluation Criteria]

A: There was no change in image density between the initial time and after printing of 1.50 million sheets, and high image quality was obtained.

B: Although the image density slightly declined after printing of 1.50 million sheets, high image quality was obtained.

C: The image density declined after printing of 1.50 million sheets, and the image quality degraded.

D: The image density significantly declined after printing of 1.50 million sheets, and the image quality greatly degraded.

<Toner Scattering>

After continuous printing of 1,500,000 sheets of chart with a 5% image coverage on a tandem type color image forming apparatus (IMAGIO NEO 450, manufactured by Ricoh Co., LTD.), the degree of toner contamination in the apparatus was visually evaluated at four grades according to the following criteria.

[Evaluation Criteria]

A: Excellent condition; completely no toner contamination in the apparatus

B: Satisfactory condition; no toner contamination in the apparatus

C: Practically usable despite toner contamination in the apparatus.

D: Practically unusable with severe toner contamination in the apparatus.

<Background Smears>

The degree of background smears in an image background part, when measured after continuous printing of 1,500,000 sheets of chart with a 5% image coverage on a tandem type color image forming apparatus (IMAGIO NEO 450, manufactured by Ricoh Co., LTD.), was visually evaluated according to the following criteria.

[Evaluation Criteria]

A: No background smears in the image background part

B: Slight background smears in the image background part

C: Background smears in the image background part

<Overall Evaluation>

Based on the above evaluation results, the developers were comprehensively evaluated according to the following criteria.

[Evaluation Criteria]

A: Very good

B: Good

C: Poor

TABLE A1

| | Carrier | Toner | Image Density | Toner Scattering | Background Smears | Overall evaluation |
|---|---|---|---|---|---|---|
| Example A-6 | Carrier A1 | Toner 3 | A | A | A | A |
| Example A-7 | Carrier A1 | Toner 2 | A | A | A | A |
| Example A-8 | Carrier A1 | Toner 1 | A | A | A | A |
| Example A-9 | Carrier A2 | Toner 3 | A | B | A | B |
| Example A-10 | Carrier A3 | Toner 3 | A | B | A | B |
| Example A-11 | Carrier A4 | Toner 3 | A | B | A | B |
| Example A-12 | Carrier A5 | Toner 3 | B | B | B | B |
| Reference Example A-2 | Reference Carrier A1 | Toner 3 | B | C | B | B |
| Comparative Example A-3 | Comparative Carrier A1 | Toner 3 | D | D | C | C |
| Comparative Example A-4 | Comparative Carrier A2 | Toner 2 | D | D | C | C |
| Comparative Example A-5 | Comparative Carrier A2 | Toner 3 | D | D | C | C |

From the results of Table A1, it could be confirmed that the developers of Examples A-6 to A-12 using the carriers A1 to A5 whose coating layers were formed with a coating material composed of a plurality of types of materials by being treated with a supercritical fluid cause less toner scattering and background smears and allow obtaining a higher image density than those of the developers of Reference Example A-2 and Comparative Examples A-3 to A-5 using the reference carriers A1 and the comparative carriers A1 to A2.

Example B-1

Preparation of Carrier B1

By use of the apparatus shown in FIG. 1, in the carrier treatment tank (inner capacity 400 mL) 251, 7 parts by mass of a methyl silicone resin A (weight-average molecular weight (Mw)=1,800, number-average molecular weight (Mn)=1,200, Mw/Mn=1.50) and 100 parts by mass of ferrite cores (saturation magnetic moment at 1 k Gauss=65 emu/g) having a volume-average particle diameter of 35 μm (surface area 7.27 $m^2$) were charged and stirred, while the valve 252 was opened to feed carbon dioxide (purity=99.5%, produced by Gastec Service, Inc.) by a pressure pump 253 to make the tank interior reach 25 MPa and 40° C., and then the valve 252 was closed.

After maintaining the interior of the carrier treatment tank 251 at 25 MPa and 40° C. for two hours, the valve 254 and valve 255 were opened, and the pressure was restored to a normal pressure in two hours. Furthermore, the carrier treatment tank 251 was heated at 160° C. for two hours. Here, an unused amino amino-modified methyl silicone resin could be recovered from both the carrier treatment tank 251 and raw-material recovery tank 262 and could be recycled.

The thickness of a coating layer of the Carrier B1 obtained was 0.35 μm, and electrical resistance was LogR=13.5 Ω·cm.

Example B-2

Preparation of Carrier B2

Carrier B2 was prepared in the same manner as that of Example B-1 except that the methyl silicone resin A used in Example B-1 was changed to a methyl silicone resin B (weight-average molecular weight (Mw)=1,300, number-average molecular weight (Mn)=900, Mw/Mn=1.44).

The thickness of a coating layer of the Carrier B2 obtained was 0.34 μm, and electrical resistance was LogR=13.5 Ω·cm.

Example B-3

Preparation of Carrier B3

Carrier B3 was prepared in the same manner as that of Example B-1 except that the methyl silicone resin A used in Example B-1 was changed to a methyl silicone resin C (weight-average molecular weight (Mw)=2,500, number-average molecular weight (Mn)=1,300, Mw/Mn=1.92).

The thickness of a coating layer of the Carrier B3 obtained was 0.34 μm, and electrical resistance was LogR=13.5 Ω·cm.

Example B-4

Preparation of Carrier B4

Carrier B4 was prepared in the same manner as that of Example B-1 except that the methyl silicone resin A used in Example B-1 was changed to a methyl silicone resin D (weight-average molecular weight (Mw)=3,700, number-average molecular weight (Mn)=1,800, Mw/Mn=2.06).

The thickness of a coating layer of the Carrier B4 obtained was 0.36 μm, and electrical resistance was LogR=13.6 Ω·cm.

Example B-5

Preparation of Carrier B5

Carrier B5 was prepared in the same manner as that of Example B-1 except that the amount of the methyl silicone resin A used in Example B-1 was changed to 21 parts by mass.

The thickness of a coating layer of the Carrier B5 obtained was 0.92 μm, and electrical resistance was LogR=13.8 Ω·cm.

Example B-6

Preparation of Carrier B6

Carrier B6 was prepared in the same manner as that of Example B-1 except that the amount of the methyl silicone resin A used in Example B-1 was changed to 2.1 parts by mass.

The thickness of a coating layer of the Carrier B6 obtained was 0.13 μm, and electrical resistance was LogR=12.3 Ωcm.

Example B-7

Preparation of Carrier B7

Carrier B7 was prepared in the same manner as that of Example B-1 except that the methyl silicone resin A used in Example B-1 was changed to a methyl silicone resin B (weight-average molecular weight (Mw)=1,300, number-average molecular weight (Mn)=900, Mw/Mn=1.44) and that the amount thereof was changed to 21 parts by mass.

The thickness of a coating layer of the Carrier B7 obtained was 0.94 μm, and electrical resistance was LogR=13.9 Ω·cm.

Comparative Example B-1

Preparation of Comparative Carrier B1

Comparative Carrier B1 was prepared in the same manner as that of Example B-1 except that the methyl silicone resin A used in Example B-1 was changed to a methyl silicone resin E (weight-average molecular weight (Mw)=6,500, number-average molecular weight (Mn)=2,700, Mw/Mn=2.41), that the amount thereof was changed to 28 parts by mass, and that the temperature was changed to 100° C.

Although the thickness of a coating layer of the Comparative Carrier B1 obtained was 0.95 μm, fine particles made only of the silicone resin were simultaneously produced, so that uniform carriers could not be obtained. In addition, aggregation of the raw-material coating resin remaining in the manufacturing container and particles was obtained, and evaluation of carriers was discontinued.

Comparative Example B-2

Preparation of Comparative Carrier B2

Comparative Carrier B2 was prepared in the same manner as that of Example B-1 except that the methyl silicone resin A used in Example B-1 was changed to a methyl silicone resin F (weight-average molecular weight (Mw)=500, number-average molecular weight (Mn)=300, Mw/Mn=1.67) and the amount thereof was changed to 0.35 parts by mass.

The thickness of a coating layer of the carrier B2 obtained was 0.04 μm, and electrical resistance was LogR=11.2 Ω·cm.

Table A below lists values of R/S (ratio of silicone resin amount R (g) to surface area S ($m^2$) of core (S)) for the prepared carriers. Note that the surface area per 1 part by mass of ferrite base material is 0.0727 $m^2$.

TABLE A

| Carrier type | R/S |
|---|---|
| Carrier B1 | 0.96 |
| Carrier B2 | 0.96 |
| Carrier B3 | 0.96 |
| Carrier B4 | 0.96 |
| Carrier B5 | 2.89 |
| Carrier B6 | 0.29 |
| Carrier B7 | 2.89 |
| Comparative Carrier B1 | 3.85 |
| Comparative Carrier B2 | 0.05 |

Examples B-8 to B-16 and Comparative Examples B-3 to B-5

Preparation of Developer

Using the prepared Carriers B1 to B7 and Comparative Carriers B1 to B2 in combination with Toners 1 to 3 as shown in the following Table B1, respective developers of Examples B-8 to B-16 and Comparative Examples B-3 to B-5 were prepared with a conventional method.

By use of the obtained respective developers, evaluations of image density, toner scattering, and background smears and a comprehensive evaluation were conducted in the following manner. The results are shown in Table B1.

<Image Density>

Next, with the obtained respective developers, by use of a tandem type color image forming apparatus (IMAGIO NEO 450, manufactured by Ricoh Co., LTD.), solid images with an amount of adhesion of the respective developers of 1.00±0.05 mg/$cm^2$ were formed on sheets of copy paper (TYPE 6000 <70W>, manufactured by Ricoh Co., LTD.). The solid image formation was repeatedly carried out for 1,500,000 sheets of the copy paper.

The image density of the obtained solid images at the initial time and after printing of 1,500,000 sheets was visually observed and evaluated based on the following criteria. Here, the higher the obtained density is, an image of the higher density can be formed. This evaluation is equivalent to an example of a process cartridge, an image forming apparatus, and an image forming method used in the present invention.

[Evaluation Criteria]

A: There was no change in image density between the initial time and after printing of 1.50 million sheets, and high image quality was obtained.

B: Although the image density slightly declined after printing of 1.50 million sheets, high image quality was obtained.

C: The image density declined after printing of 1.50 million sheets, and the image quality degraded.

D: The image density significantly declined after printing of 1.50 million sheets, and the image quality greatly degraded.

<Toner Scattering>

After continuous printing of 1,500,000 sheets of chart with a 5% image coverage on a tandem type color image forming apparatus (IMAGIO NEO 450, manufactured by Ricoh Co., LTD.), the degree of toner contamination in the apparatus was visually evaluated at four grades according to the following criteria.

[Evaluation Criteria]

A: Excellent condition; with completely no toner contamination in the apparatus

B: Satisfactory condition; with no toner contamination in the apparatus

C: Practically usable despite toner contamination in the apparatus.

D: Practically unusable with severe toner contamination in the apparatus.

<Background Smears>

The degree of background smears in an image background part after continuous printing of 1,500,000 sheets of chart with a 5% image coverage on a tandem type color image forming apparatus (IMAGIO NEO 450, manufactured by Ricoh Co., LTD.) was visually evaluated according to the following criteria.

[Evaluation Criteria]

A: No background smears in the image background part

B: Slight background smears in the image background part

C: Background smears in the image background part

<Overall Evaluation>

Based on the above evaluation results, the developers were comprehensively evaluated according to the following criteria.

[Evaluation Criteria]

A: Very good

B: Good

C: Poor

TABLE B1

| | | | Image Density | Toner Scattering | Background Smears | Comprehensive evaluation |
|---|---|---|---|---|---|---|
| Example B-8 | Carrier B1 | Toner 3 | A | A | A | A |
| Example B-9 | Carrier B1 | Toner 2 | A | A | A | A |
| Example B-10 | Carrier B1 | Toner 1 | A | A | A | A |
| Example B-11 | Carrier B2 | Toner 3 | A | B | A | B |
| Example B-12 | Carrier B3 | Toner 3 | A | B | A | B |
| Example B-13 | Carrier B4 | Toner 3 | A | B | A | B |
| Example B-14 | Carrier B5 | Toner 3 | B | C | A | B |
| Example B-15 | Carrier B6 | Toner 3 | B | B | A | B |
| Example B-16 | Carrier B7 | Toner 3 | B | C | A | B |
| Comparative Example B-3 | Comparative Carrier B1 | Toner 3 | — | — | — | C |
| Comparative Example B-4 | Comparative Carrier B2 | Toner 2 | D | D | C | C |
| Comparative Example B-5 | Comparative Carrier B2 | Toner 3 | D | D | C | C |

From the results of Table B1, it could be confirmed that the developers of Examples B-8 to B-16 using the carriers B1 to B7 treated with a supercritical fluid cause less toner scattering and background smears and allow obtaining a higher image density than those of the developers of Comparative Examples B-3 to B-5.

What is claimed is:

1. A method for manufacturing a carrier, comprising:

providing a core;

dissolving a coating material comprising a plurality of resins in a fluid containing at least one of a supercritical fluid and a subcritical fluid to prepare a solution;

lowering a solubility of the solution by controlling at least one of pressure and temperature; and forming a coating layer on a core surface, wherein the resins differ in solubility to the supercritical fluid and to the subcritical fluid from each other, and the resins are amino-modified silicone resins.

2. The method according to claim 1, wherein the coating material is applied on the core surface under coexistence of the coating material comprising a plurality of the resins.

3. The method according to claim 1, wherein one of the supercritical fluid and subcritical fluid is carbon dioxide.

4. The method according to claim 1, wherein the coating material comprises three to five of the resins.

5. The method according to claim 1, wherein the coating material comprises five of the resins.

6. The method according to claim 1, wherein the coating material comprises resins that differ in a number of functional groups.

7. The method according to claim 1, wherein the amino-modified resins each contain as a main skeleton the following structural formula (i):

Structural Formula (i)

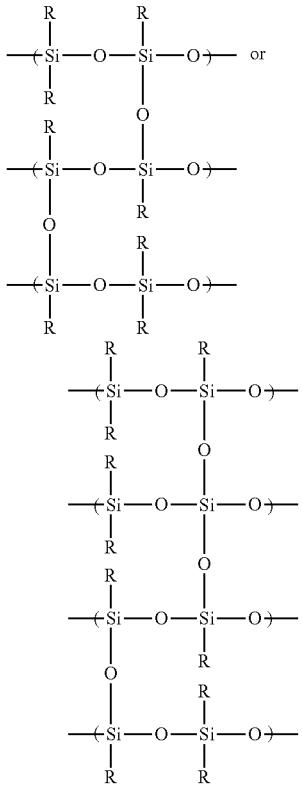

where R represents a hydrogen atom, hydroxyl group, alkoxy group, alkyl group, aryl group, or amino group.

8. The method according to claim 1, wherein the coating material comprises resins that differ in the amino modification ratio from each other.

9. The method according to claim 7, wherein the silicone resins have a weight-average molecular weight (Mw) of 500 to 100,000.

* * * * *